US008357011B2

(12) United States Patent
Murray et al.

(10) Patent No.: US 8,357,011 B2
(45) Date of Patent: Jan. 22, 2013

(54) PLUG ASSEMBLY FOR TELECOMMUNICATIONS CABLE

(75) Inventors: David Patrick Murray, Bishopston (GB); Kamlesh G. Patel, Chanhassen, MN (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 28 days.

(21) Appl. No.: 12/884,794

(22) Filed: Sep. 17, 2010

(65) Prior Publication Data

US 2011/0201236 A1 Aug. 18, 2011

Related U.S. Application Data

(60) Provisional application No. 61/243,399, filed on Sep. 17, 2009.

(51) Int. Cl.
*H01R 24/04* (2006.01)

(52) U.S. Cl. ..... 439/668; 439/404

(58) Field of Classification Search ..... 439/404, 439/417, 610

See application file for complete search history.

(56) References Cited

U.S. PATENT DOCUMENTS

| | | | | |
|---|---|---|---|---|
| 5,586,916 | A * | 12/1996 | Shinji et al. | 439/752 |
| 5,975,936 | A | 11/1999 | Lin et al. | |
| 6,370,769 | B1 | 4/2002 | Lilienthal, II | |
| 6,520,807 | B2 * | 2/2003 | Winings | 439/676 |
| 6,752,647 | B1 * | 6/2004 | Lin | 439/412 |
| 7,229,309 | B2 | 6/2007 | Carroll et al. | |
| RE40,375 | E * | 6/2008 | Abel et al. | 439/417 |
| 7,413,464 | B1 * | 8/2008 | Chen | 439/404 |
| 7,573,159 | B1 | 8/2009 | Deluliis et al. | |
| 7,918,684 | B2 * | 4/2011 | Lu | 439/395 |
| 2006/0205277 | A1 | 9/2006 | Gordon et al. | |

FOREIGN PATENT DOCUMENTS

| | | |
|---|---|---|
| JP | 7-312262 | 11/1995 |
| JP | 2002-237360 | 8/2002 |
| JP | 2005-293958 | 10/2005 |

OTHER PUBLICATIONS

International Search Report and Written Opinion mailed Mar. 31, 2011.

* cited by examiner

*Primary Examiner* — Tulsidas C Patel
*Assistant Examiner* — Travis Chambers
(74) *Attorney, Agent, or Firm* — Merchant & Gould P.C.

(57) ABSTRACT

A plug assembly includes a sleeve and a connector assembly. The sleeve includes a first axial end portion and a second axial end portion. The second axial end portion defines a plurality of channels. The connector assembly is engaged to the second axial end portion of the sleeve. The connector assembly includes a connector body, a plurality of contacts and a plug. The plurality of contacts is disposed in the connector body. Each of the plurality of contacts includes a first end and a second end. The first ends of the plurality of channels are disposed in the plurality of channels of the sleeve. The plug is engaged to the connector body. The plug includes a plurality of grooves through which the second ends of the plurality of contacts are accessible.

23 Claims, 23 Drawing Sheets

PLUG ASSEMBLY FOR TELECOMMUNICATIONS CABLE

CROSS-REFERENCE TO RELATED APPLICATION

This application claims the benefit of U.S. Provisional Patent Application Ser. No. 61/243,399, filed Sep. 17, 2009, which application is hereby incorporated by reference in its entirety.

BACKGROUND

Network systems typically include multiple plugs and jacks. Plugs are typically terminated in a factory setting while jacks are typically terminated in the field. During the termination process, the wire twist and the position of the wires in relation to other wires should be sufficiently maintained in order to maximize the radio frequency performance. However, variations in manual termination result in variations in the radio frequency performance of the plugs and jacks.

SUMMARY

An aspect of the present disclosure relates to a plug assembly for terminating a telecommunications cable. The plug assembly includes a sleeve and a connector assembly. The sleeve includes a first axial end portion and a second axial end portion. The second axial end portion defines a plurality of channels. The connector assembly is engaged to the second axial end portion of the sleeve. The connector assembly includes a connector body, a plurality of contacts and a plug. The connector body includes a first end portion and a second end portion. The plurality of contacts is disposed in the connector body. Each of the plurality of contacts includes a first end that extends outwardly from the first end portion of the connector body and a second end that extends outwardly from the second end portion of the connector body. The first ends of the plurality of channels are disposed in the plurality of channels of the sleeve. The plug is engaged to the second end portion of the connector body. The plug includes a plurality of grooves through which the second ends of the plurality of contacts are accessible.

Another aspect of the present disclosure relates to a cable assembly. The cable assembly includes a plug assembly having a sleeve and a connector assembly. The sleeve includes a first axial end portion and a second axial end portion and defines a bore that extends through the first and second axial end portions. The second axial end portion defining a plurality of slots. The connector assembly is engaged to the second axial end portion of the sleeve. The connector assembly includes a connector body, a plurality of contacts and a plug. The connector body includes a first end portion and a second end portion. The plurality of contacts is disposed in the connector body. Each of the plurality of contacts includes a first end that extends outwardly from the first end portion of the connector body and a second end that extends outwardly from the second end portion of the connector body. The plug is engaged to the second end portion of the connector body. The plug includes a plurality of grooves through which the second ends of the plurality of contacts are accessible. The cable assembly further includes a cable having an end disposed in the bore of the sleeve. The cable includes a plurality of wires extending into the plurality of slots in the sleeve and being in contact with the first ends of the plurality of contacts.

Another aspect of the present disclosure relates to a method for installing a plug assembly to a cable. The method includes inserting an end portion of the cable into a bore of a sleeve of a plug assembly. The wires of the cable are inserted into slots of the sleeve so that the wires extend radially outward from the cable. A connector assembly of the plug assembly is aligned with the sleeve. The connector assembly is engaged to the sleeve so that first ends of contacts in the connector assembly are in contact with the wires in the slots.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DRAWINGS

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Figure 1:
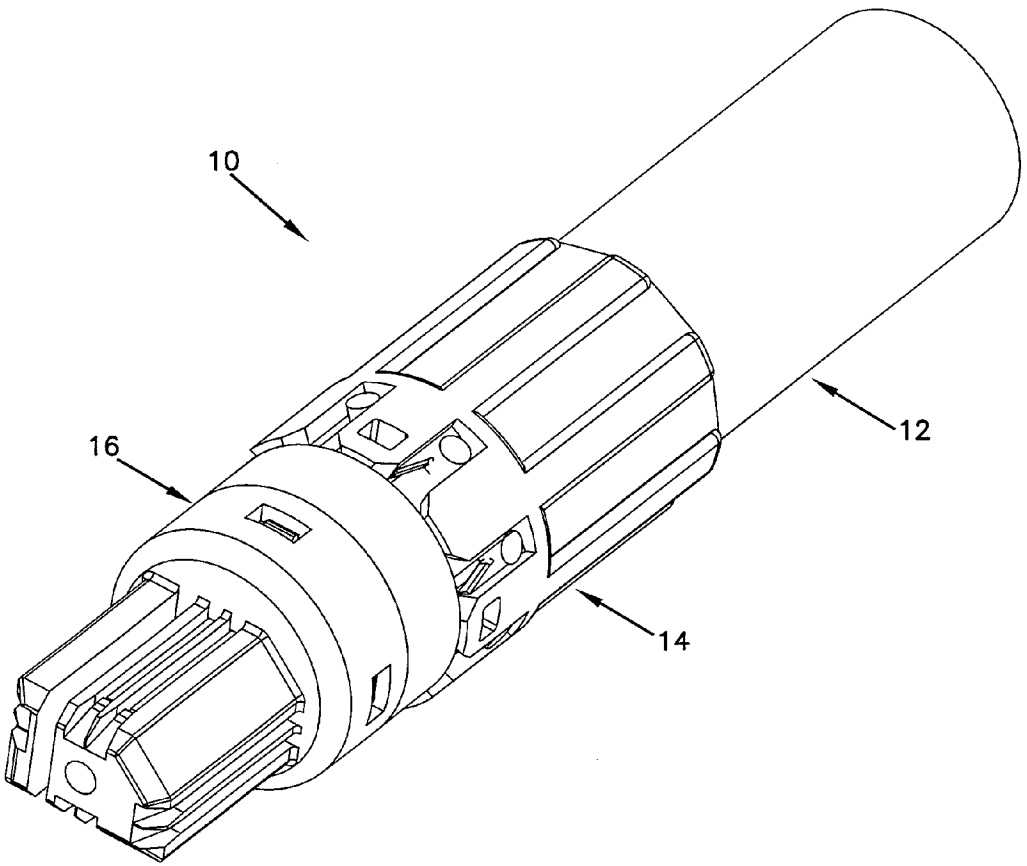
FIG. 1 is an isometric view of a plug assembly having exemplary features of aspects in accordance with the principles of the present disclosure.

Referring now to FIG. 1, a cable assembly, generally designated 10, is shown. The cable assembly 10 includes a plug assembly 11 and a telecommunications cable 12. The plug assembly 11 is adapted for use in terminating the telecommunications cable 12. One potential advantage of the plug assembly 11 of the present disclosure is reduction in installation time as compared to conventional terminations, which results in reduced installation costs. The plug assembly 11 includes a sleeve 14 and a connector assembly 16.

Figure 2:
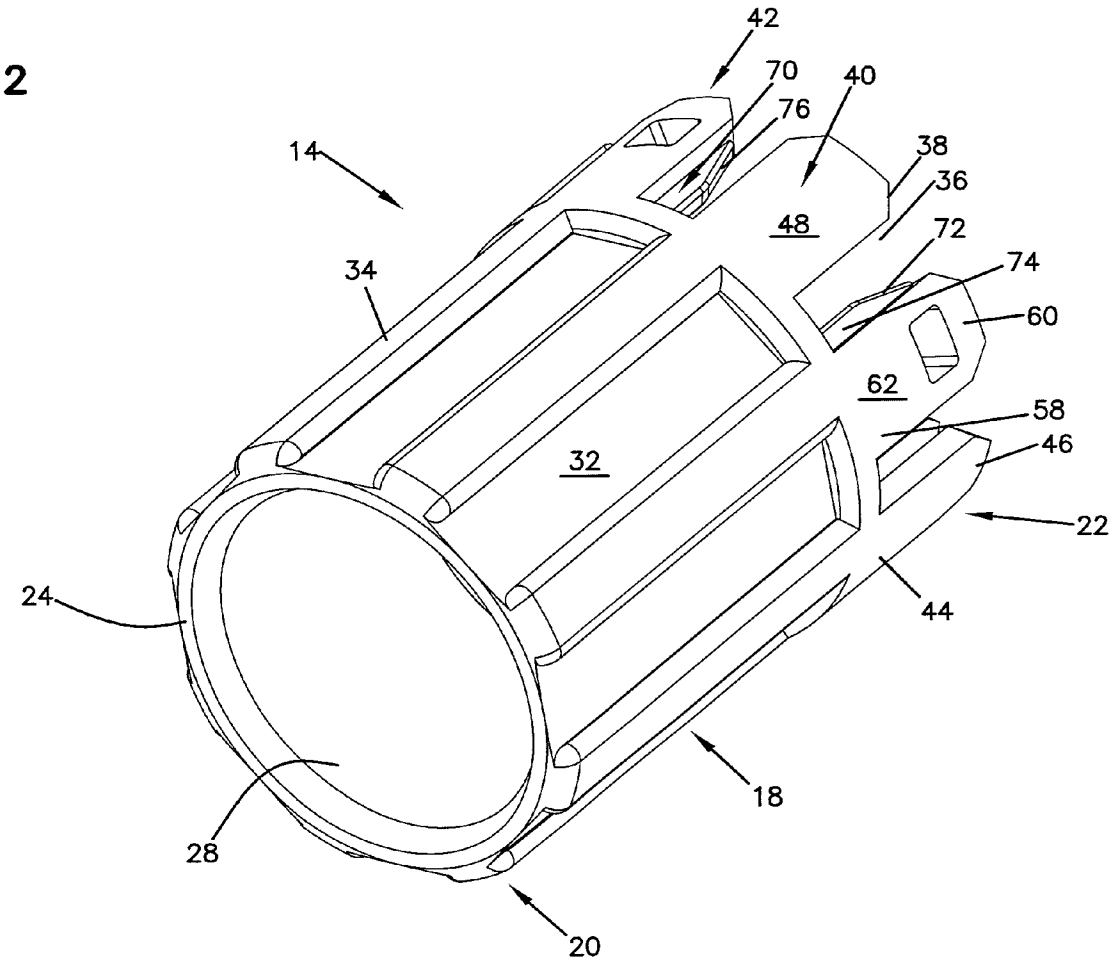
FIGS. 2 and 3 are isometric views of a sleeve suitable for use with the plug assembly of FIG. 1.
Figure 3:
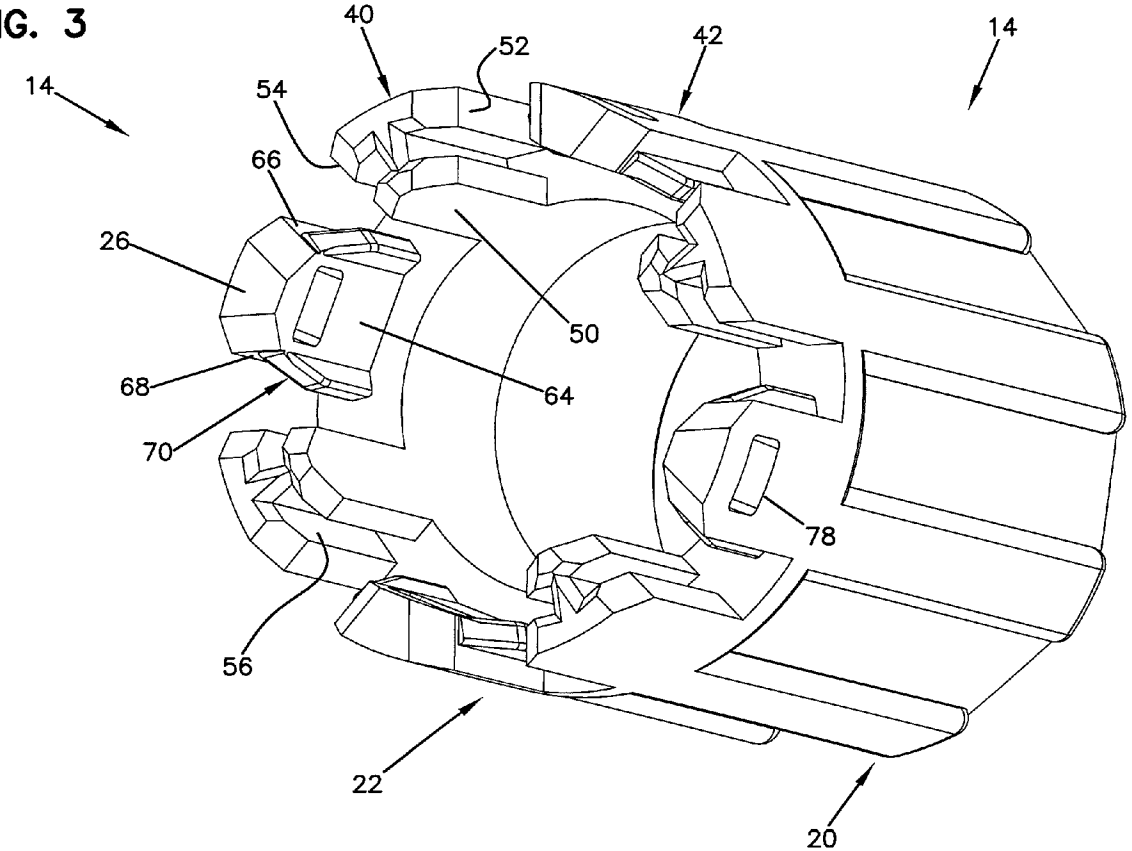

Referring now to FIG. 2-3, the sleeve 14 is shown. In one aspect of the present disclosure, the sleeve 14 is generally cylindrical in shape. The sleeve 14 includes a body 18 having a first axial end portion 20 and an oppositely disposed second axial end portion 22. The first axial end portion 20 includes a first end surface 24 while the second axial end portion 22 includes a second end surface 26. In one aspect of the present disclosure, an outer diameter of the first axial end portion 20 is equal to an outer diameter of the second axial end portion 22.

The sleeve 14 defines a bore 28 that extends through the first and second axial end portions 20, 22 along a central longitudinal axis 30. The bore 28 is adapted to receive the telecommunications cable 12.

An outer surface 32 of the first axial end portion 20 includes a plurality of ribs 34. Each of the plurality of ribs 34 extends in an axial direction along the first axial end portion 20.

The second axial end portion 22 of the sleeve 14 defines a plurality of slots 36. In one aspect of the present disclosure, the second axial end portion 22 of the sleeve 14 defines eight slots 36. Each of the plurality of slots 36 includes an opening 38 in the second end surface 26 of the second axial end portion 22.

The second axial end portion 22 of the sleeve 14 includes a first plurality of tabs 40 and a second plurality of tabs 42. In one aspect of the present disclosure, there the first plurality of tabs 40 includes four tabs 40 while the second plurality of tabs 42 includes four tabs 42. In one aspect of the present disclosure, each of the first plurality of tabs 40 is arranged about the central longitudinal axis 30 such that each of the first plurality of tabs 40 is about 90 degrees from an adjacent tab 40 of the first plurality of tabs 40. In another aspect of the present disclosure, each of the second plurality of tabs 42 is arranged about the central longitudinal axis 30 such that each of the second plurality of tabs 42 is about 90 degrees from an adjacent tab 42 of the second plurality of tabs 42 and about 45 degrees from an adjacent tab 40 of the first plurality of tabs 40.

The first and second pluralities of tabs 40, 42 extend outwardly from the second axial end portion 22 in an axial direction that is generally parallel to the central longitudinal axis 30. In one aspect of the present disclosure, the first and second pluralities of tabs 40, 42 are alternately arranged about the central longitudinal axis 30 with the plurality of slots 36 disposed between the first and second pluralities of tabs 40, 42.

Each of the first plurality of tabs 40 includes a base end 44, a free end 46, an outer surface 48, an inner surface 50, a first side 52 and an oppositely disposed second side 54. The base end 44 is engaged to the body 18 of the sleeve 14. In one aspect of the present disclosure, the base end 44 is integral with the body 18. In another aspect of the present disclosure, the base end 44 and the body 18 are monolithic.

Each of the first and second sides 52, 54 of each of the first plurality of tabs 40 defines a channel 56. Each channel 56 is disposed between the outer and inner surfaces 48, 50 of each of the first plurality of tabs 40.

Each of the second plurality of tabs 42 includes a base end 58, a free end 60, an outer surface 62, an inner surface 64, a first side 66 and an oppositely disposed second side 68. The base end 58 is engaged to the body 18 of the sleeve 14. In one aspect of the present disclosure, the base end 58 is integral with the body 18. In another aspect of the present disclosure, the base end 58 and the body 18 are monolithic.

The second plurality of tabs 42 includes a plurality of protrusions 70. Each of the first and second sides 66, 68 of the second plurality of tabs 42 includes one of the protrusions 70. In one aspect of the present disclosure, each of the protrusions 70 extends outwardly from the one of the corresponding first and second sides 66, 68 into the adjacent slot 36. Each of the protrusions 70 effectively decreases the width of the adjacent slot 36. In one aspect of the present disclosure, each of the protrusions 70 is disposed adjacent to one of the inner surfaces 64 of the second plurality of tabs 42.

Each of the protrusions 70 includes a first portion 72 and a second portion 74. The first portion 72 of the protrusion 70 has an angled surface 76 that extends increasingly outwardly as the axial distance increases from the free end 60 to the base end 58. The second portion 74 of the protrusion 70 extends outwardly from the first and second sides 66, 68 into the slot 36 at a generally constant distance.

Each of the second plurality of tabs 42 defines a catch 78. The catch 78 extends through the outer and inner surfaces 62, 64 of the second plurality of tabs 42. In one aspect of the present disclosure, the catch 78 is disposed adjacent to the free end 60. In another aspect of the present disclosure, the catch 78 is generally rectangular in shape.

Figure 4:
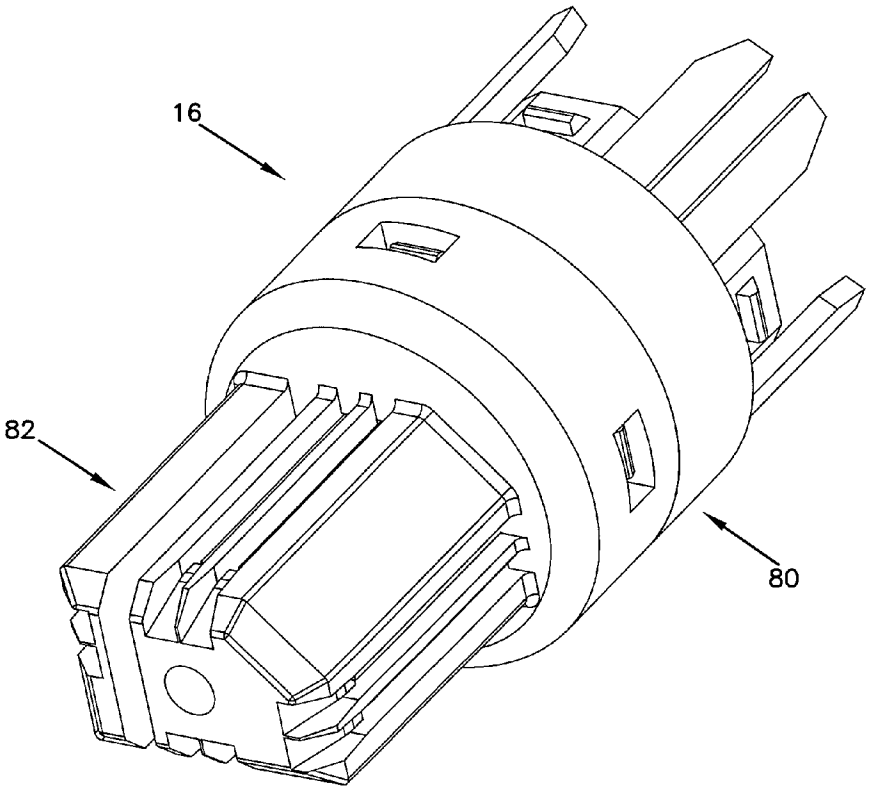
FIGS. 4 and 5 are isometric views of a connector assembly suitable for use with the plug assembly of FIG. 1.
Figure 5:
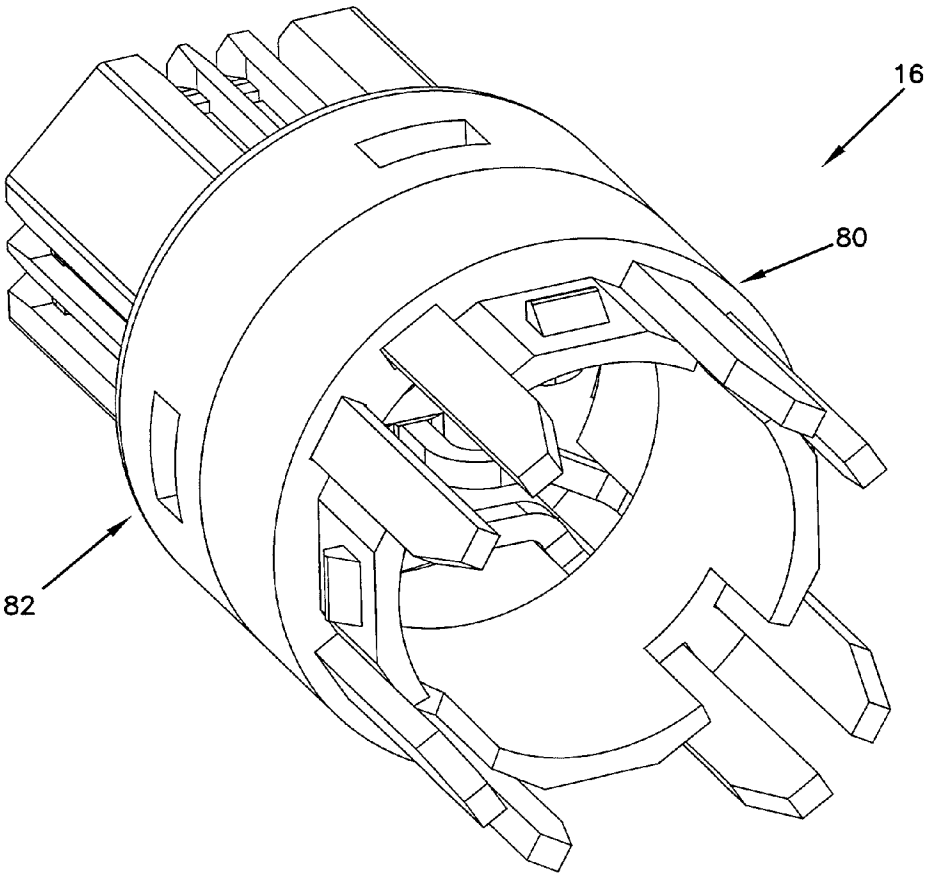

Referring now to FIGS. 4 and 5, the connector assembly 16 is shown. The connector assembly 16 includes a connector 80 and a plug 82.

Figure 6:
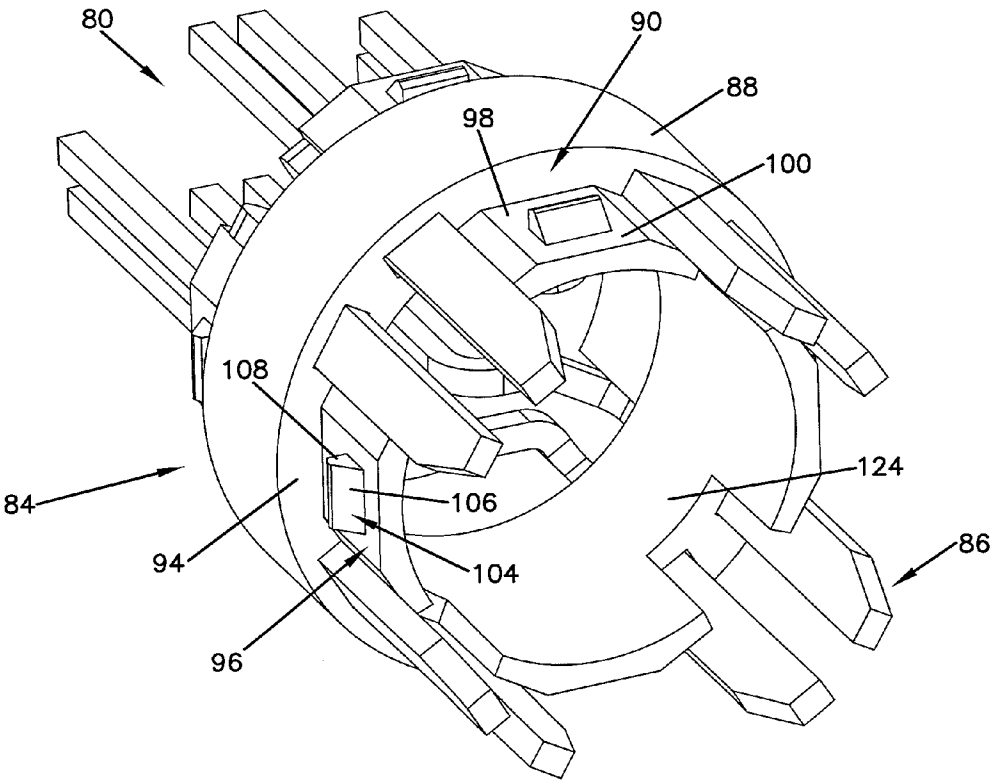
FIGS. 6 and 7 are isometric views of a connector suitable for use with the connector assembly of FIGS. 4 and 5.
Figure 7:
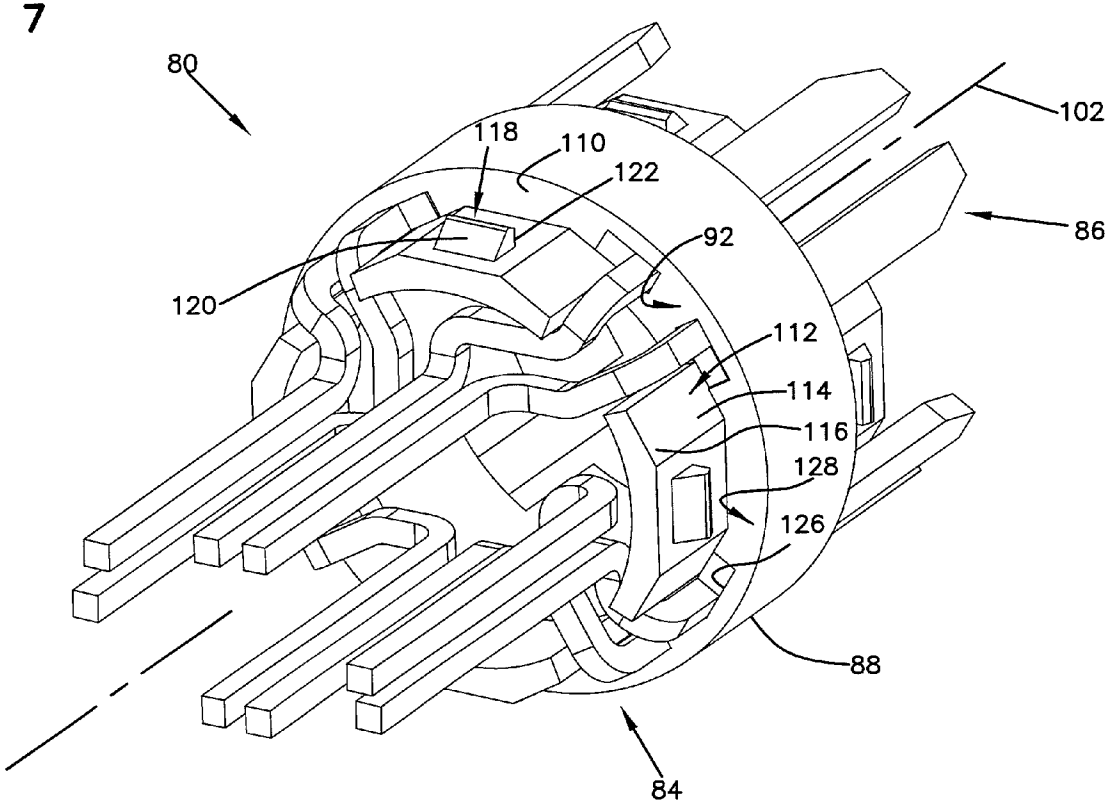

Referring now to FIGS. 6 and 7, the connector 80 is shown. The connector 80 includes a connector body 84 and a plurality of insulation displacement contacts 86.

In one aspect of the present disclosure, the connector body 84 is generally cylindrical in shape. The connector body 84 includes a collar 88. In one aspect of the present disclosure, an outer diameter of the collar 88 is less than or equal to the outer diameter of the second axial end portion 22 of the sleeve 14.

The collar 88 includes a first end portion 90 and an oppositely disposed second end portion 92. The first end portion 90 is adapted for engagement with the second axial end portion 22 of the sleeve 14.

The first end portion 90 includes a first end surface 94 and a first plurality of resilient latches 96. In one aspect of the present disclosure, the first end portion 90 includes four resilient latches 96. The first plurality of resilient latches 96 extends outwardly from the first end surface 94 of the collar 88 in a first axial direction. Each of the first plurality of resilient latches 96 includes a first base portion 98 and a first free portion 100. The first base portion 98 is engaged with the collar 88. In one aspect of the present disclosure, the first base portion 98 is integral with the collar 88.

The first free portions 100 of the first plurality of resilient latches 96 are disposed about a central axis 102 of the collar 88 such that an outer diameter formed by the first free portions 100 is less than or equal to an inner diameter of the second axial end portion 22 of the sleeve 14. Each of the first free portions 100 include a first latch protrusion 104 that extends outwardly from the first free portion 100. The first latch protrusion 104 extends outwardly in a generally radial direction. The first latch protrusion 104 includes a tapered surface 106 and a lip 108 that faces toward the first base portion 98.

The second end portion 92 includes a second end surface 110 and a second plurality of resilient latches 112. The second end surface 110 is oppositely disposed from the first end surface 94 of the first end portion 90.

In one aspect of the present disclosure, the second end portion 92 includes four resilient latches 112. The second plurality of resilient latches 112 extends outwardly from the second end surface 110 of the collar 88 in a second axial direction, which is opposite from the first axial direction.

Each of the second plurality of resilient latches 112 includes a second base portion 113 and a second free portion 116. The second base portion 114 is engaged with the collar 88. In one aspect of the present disclosure, the second base portion 114 is integral with the collar 88.

Each of the second free portions 116 include a second latch protrusion 118 that extends outwardly from the second free portion 116. The second latch protrusion 118 extends outwardly in a generally radial direction. The second latch protrusion 118 includes a tapered surface 120 and a lip 122 that faces toward the second base portion 114.

In one aspect of the present disclosure, the connector body 84 defines a central bore 124 that extends through the first and second end surfaces 94, 110 of the collar 88. The central bore 124 is aligned with the central axis 102.

In another aspect of the present disclosure, the connector body 84 defines a plurality of passages 126 that extends through the first and second end surfaces 94, 110 of the collar 88. The plurality of passages 126 is disposed about the central axis 102 and adjacent to an outer periphery portion 128 of the collar 88. Each of the plurality of passages 126 is adapted to receive one of the insulation displacement contacts 86. In one aspect of the present disclosure, each of the passages 126 is generally rectangular in shape.

Figure 8:
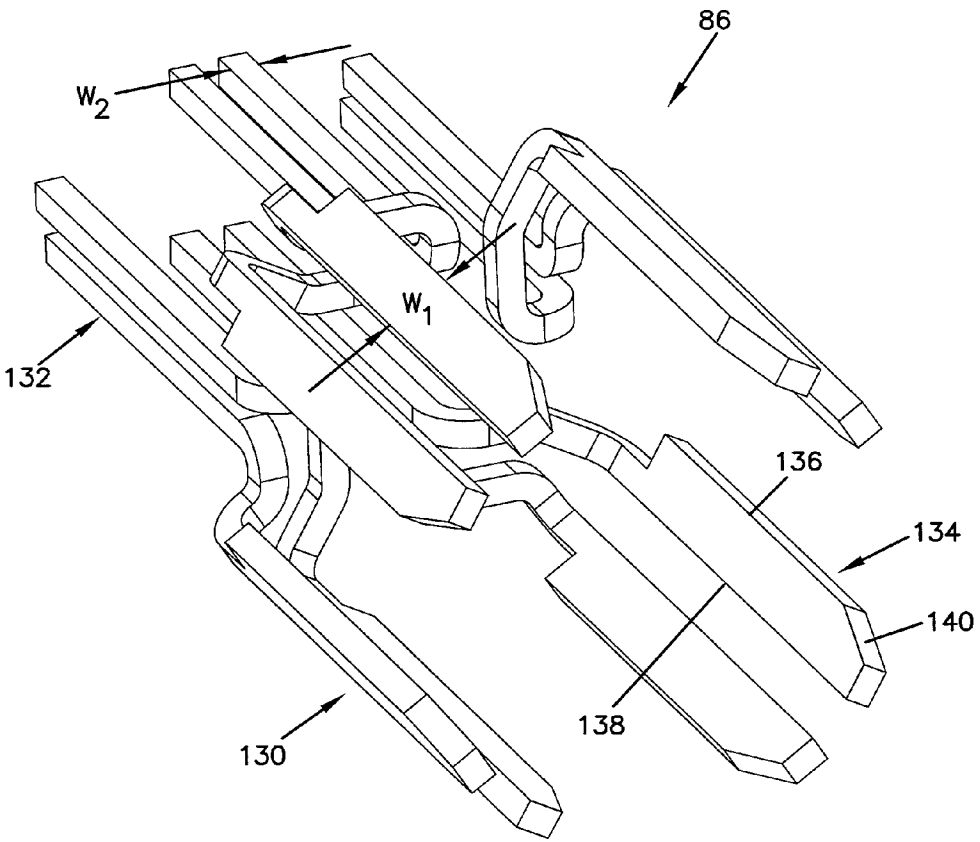
FIGS. 8 and 9 are isometric views of insulation displacement contacts suitable for use with the connector of FIGS. 6 and 7.
Figure 9:
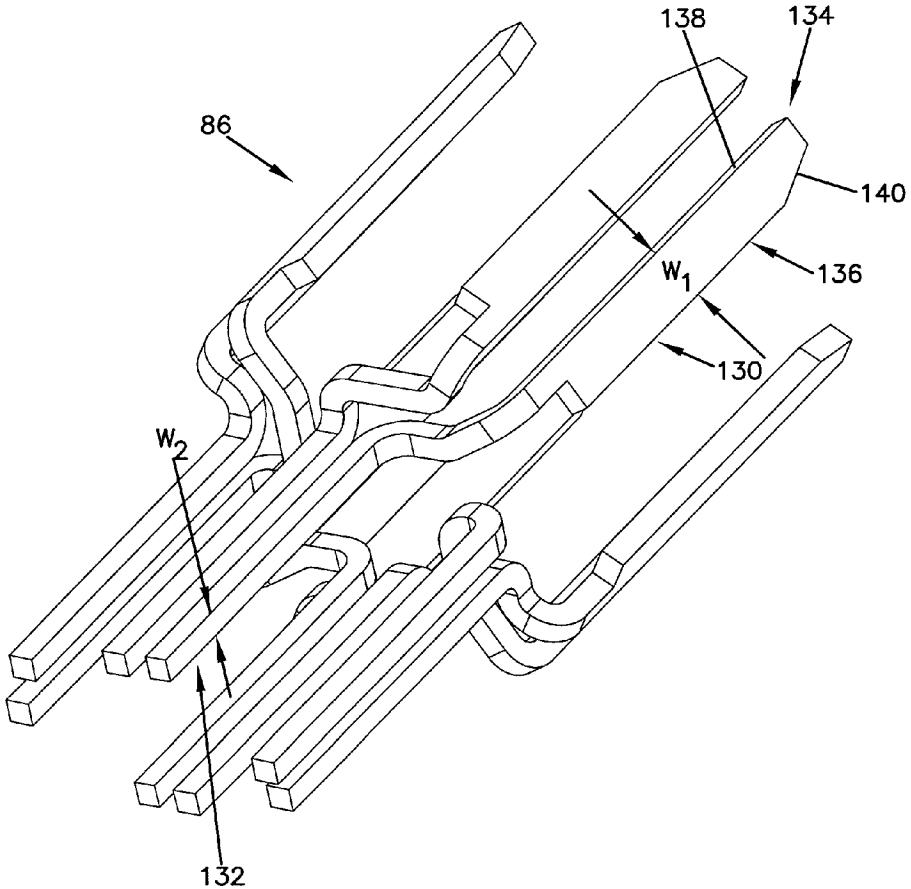

Referring now to FIGS. 8 and 9, the insulation displacement contacts 86 are shown. Each of the insulation displacement contacts 86 includes a first end 130 and a second end 132.

The first end 130 is adapted for receipt in one of the plurality of passages 126 in the collar 88 of the connector body 84 so that the first end 130 extends outwardly from the first end surface 94 of the collar 88. The first end 130 includes a blade portion 134. In one aspect of the present disclosure, the blade portion 134 has a width $W_1$ that is generally greater than a width $W_2$ of the second end 132.

The blade portion 134 includes a first side 136 and an oppositely disposed second side 138. The first side 136 is adapted for contact with the telecommunications cable 12. The first side 136 includes a tapered surface 140. The tapered surface 140 is oriented so that a distance between the second side 138 and the tapered surface 140 increases as the tapered surface 140 extends toward the second end 132.

The second side 138 of the blade portion 134 is adapted for engagement with the channel 56 of the sleeve 14. In one aspect of the present disclosure, the second side 138 is generally straight.

The second end 132 of the insulation displacement contact 86 extends outwardly from the second end surface 110 of the collar 88. The second end 132 is adapted for receipt in the plug 82. In one aspect of the present disclosure, the second end 132 is offset from the first end 130 so that a radial distance from the central axis 102 to the first end 130 is generally greater than a radial distance from the central axis 102 to the second end 132. In another aspect of the present disclosure, the cross-section of the second end 132 is generally square shaped.

Figure 10:
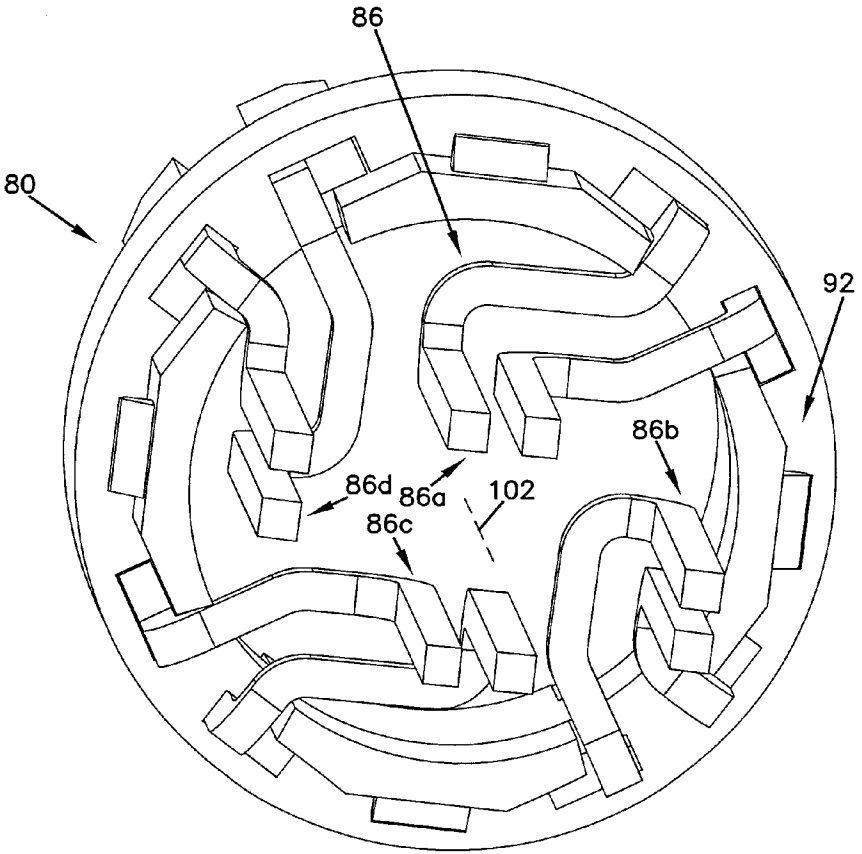
FIGS. 10 and 11 are isometric views of the connector having alternate insulation displacement contact configurations.
Figure 11:
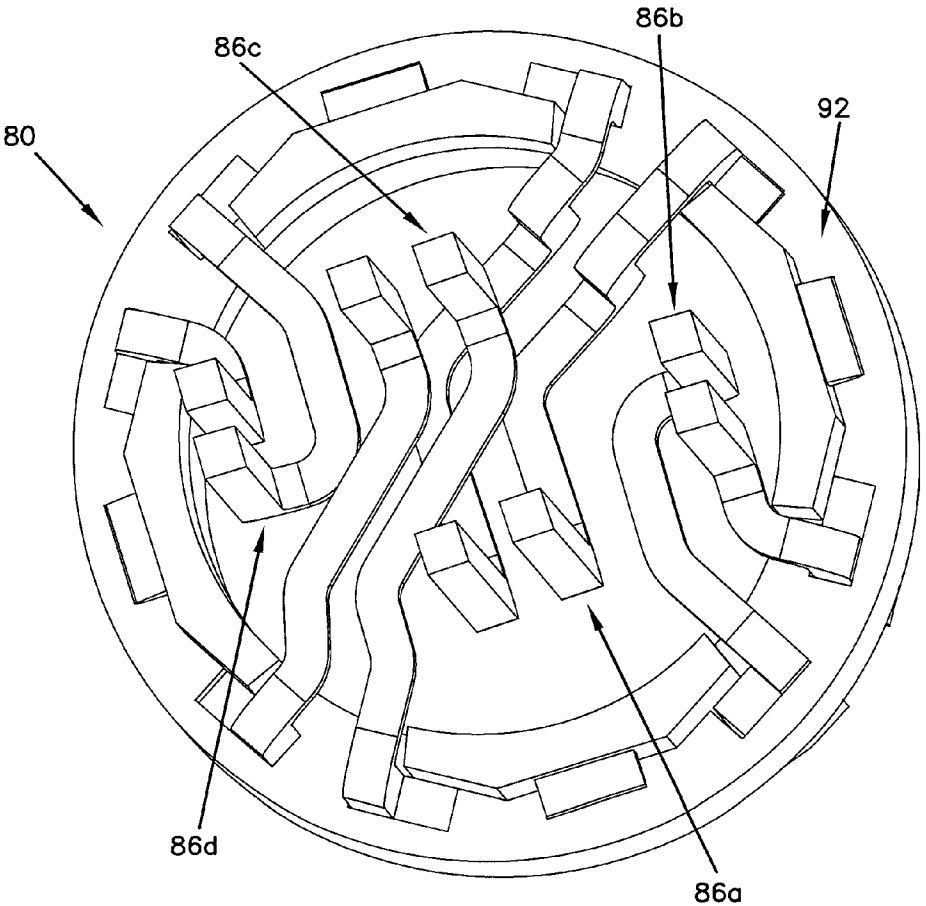

Referring now to FIGS. 10 and 11, the second end portion 92 of the connector 80 is shown with alternate configurations of the insulation displacement contacts 86. These alternate configurations are suitable for use with crossover telecommunications cables. In crossover telecommunications cables, the layout of the wires at one end of the cable is different from the layout of the wires at the opposite end of the cable. For example, in a four wire-pair crossover cable, two oppositely disposed wire-pairs change position between a first end of the crossover telecommunications cable and an opposite second end. In this example, the configuration of the insulation displacement contacts 86 shown in FIG. 10 could be used for the first end of the telecommunications cable while the configuration of the insulation displacements contacts 86 shown in FIG. 11 could be used for the second end of the telecommunications cable. In the configuration shown in FIG. 10, the insulation displacement contacts 86 include a first pair of contacts 86*a*, a second pair of contacts 86*b*, a third pair of contacts 86*c* and a fourth pair of contacts 86*d*. As depicted in FIG. 11, a first and third pair of contacts 86*a*', 86*c*' are configured and arranged such that the first pair of contacts 86*a*' occupies the location of the third pair of contacts 86*c* in FIG. 10 while the third pair of contacts 86*c*' occupies the location of the first pair of contacts 86*a* in FIG. 10.

Figure 12:
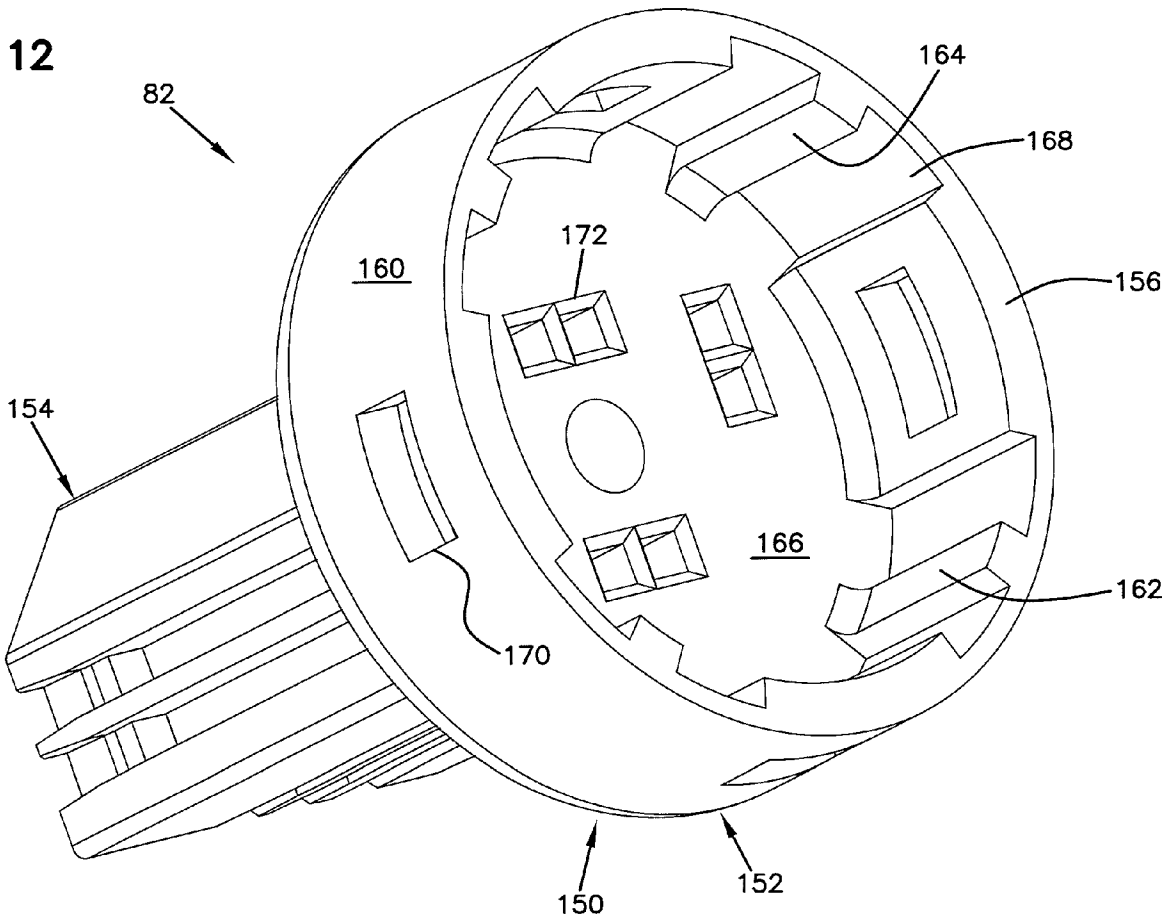
FIGS. 12 and 13 are isometric views of a plug suitable for use with the connector assembly of FIGS. 4 and 5.
Figure 13:
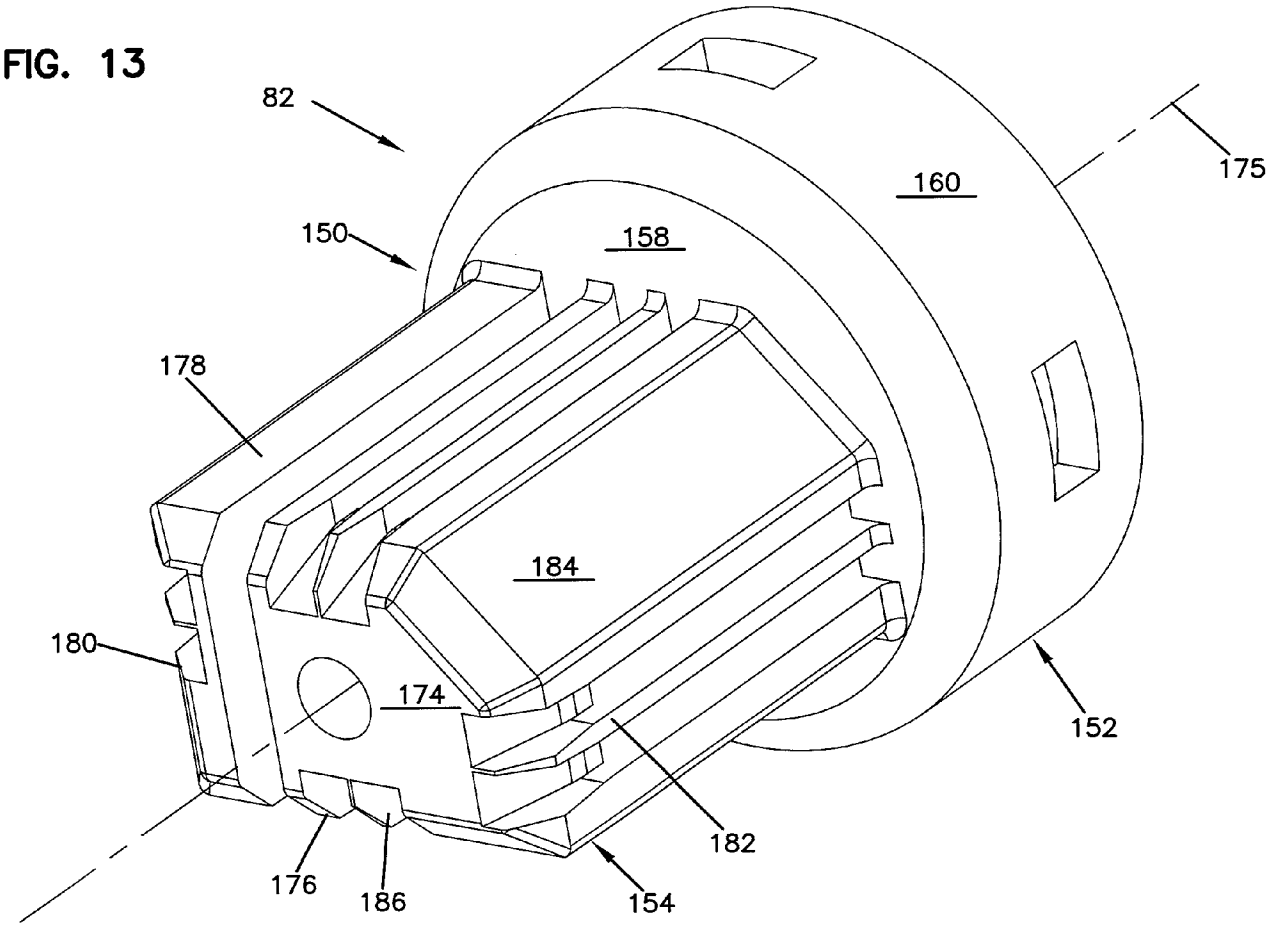

Referring now to FIGS. 12 and 13, the plug 82 is shown. The plug 82 includes a plug body 150 having a first axial end portion 152 and a second axial end portion 154.

The first axial end portion 152 of the plug body 150 includes a first end face 156 and an oppositely disposed second end face 158 (best shown in FIG. 13). The first axial end portion 152 further includes an exterior side surface 160 that extends between the first and second end faces 156, 158. In one aspect of the present disclosure, the exterior side surface 160 is generally cylindrical in shape.

The first axial end portion 152 defines a cavity 162. The cavity 162 includes an interior side surface 164 and an end surface 166. The interior side surface 164 of the cavity 162 defines a plurality of notches 168. The plurality of notches 168 extends from the first end face 156 to the end surface 166 of the cavity 162. In one aspect of the present disclosure, there are eight notches 168. Each of the plurality of notches 168 is adapted to receive a portion of one of the insulation displacement contacts 86.

The exterior side surface 160 defines a plurality of openings 170. In one aspect of the present disclosure, the exterior side surface 160 defines four openings 170. The plurality of openings 170 extends through the exterior and interior side surfaces 160, 164. The plurality of openings 170 is adapted to receive the second latch protrusions 118 of the second plurality of resilient latches 112 of the connector body 84. In one aspect of the present disclosure, the plurality of openings 170 of the plug 82 and the second plurality of resilient latches 112 of the connector body 84 are engaged via snap-fit engagement.

The end surface 166 of the cavity 162 defines a plurality of apertures 172. The apertures 172 extend through the end surface 166 and the second end face 158 of the first axial end portion 152. The apertures 172 are adapted to receive the second ends 132 of the insulation displacement contacts 86 of the connector 80.

The second axial end portion 154 extends outwardly from the second end face 158 of the first axial end portion 152. The second axial end portion 154 includes an end face 174. In one aspect of the present disclosure, the end face 174 is generally rectangular in shape. The end face 174 is generally perpendicular to a central longitudinal axis 175 of the plug 82.

The second axial end portion 154 further includes a first side wall 176, an oppositely disposed second side wall 178, a third side wall 180 and an oppositely disposed fourth side wall 182. The third and fourth side walls 180, 182 extend between the first and second side walls 176, 178. In one aspect of the present disclosure, one of the first, second, third and fourth side walls 176, 178, 180, 182 includes an angle portion 184. The angle portion 184 is oriented at an oblique angle with respect to the adjacent side wall.

The second axial end portion 154 defines a plurality of grooves 186. Each of the grooves 186 is open to the corresponding aperture 172 of the cavity 162. In one aspect of the present disclosure, the second ends 132 of the insulation displacement contacts 86 are accessible through the grooves 186.

Referring now to FIGS. 7 and 12, the assembly of the connector assembly 16 will be described. The second end portion 92 of the connector 80 is axially aligned with the first axial end portion 152 of the plug 82 and rotationally aligned so that the second ends 132 of the insulation displacement contacts 86 of the connector 80 are aligned with the apertures 172 of the end face 166 of the cavity 162 of the plug 82. With the second ends 132 of the contacts 86 aligned with the apertures 172, the second end portion 92 of the connector 80 is moved axially toward the cavity 162 of the plug 82. The contact between the tapered surfaces 120 of the second latch protrusions 118 of the connector 80 and the interior side surface 164 of the cavity 162 of the plug 82 and the axial movement of the connector 80 toward the plug 82 causes the second plurality of resilient latches 112 to move radially inward toward the central axis 102. When the second latch protrusions 118 are received in the plurality of openings 170 of the plug 82, the second plurality of resilient latches 112 move radially outwardly from the central axis 102. The connector 80 is retained in engagement with the plug 82 through the snap-fit engagement of the second latch protrusions 118 of the connector 80 and the openings 170 of the plug 82.

Figure 14:
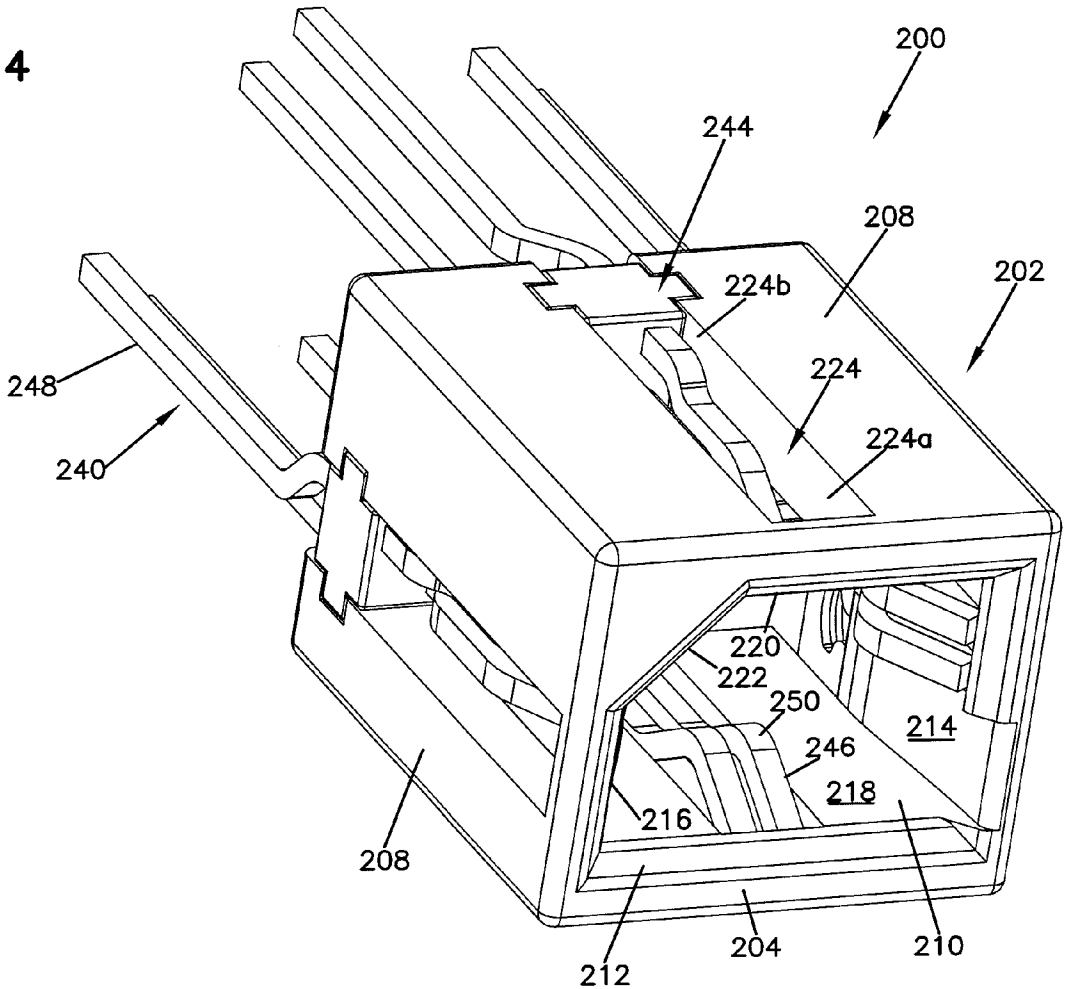
FIGS. 14 and 15 are isometric views of a socket assembly suitable for use with the plug assembly of FIG. 1.
Figure 15:
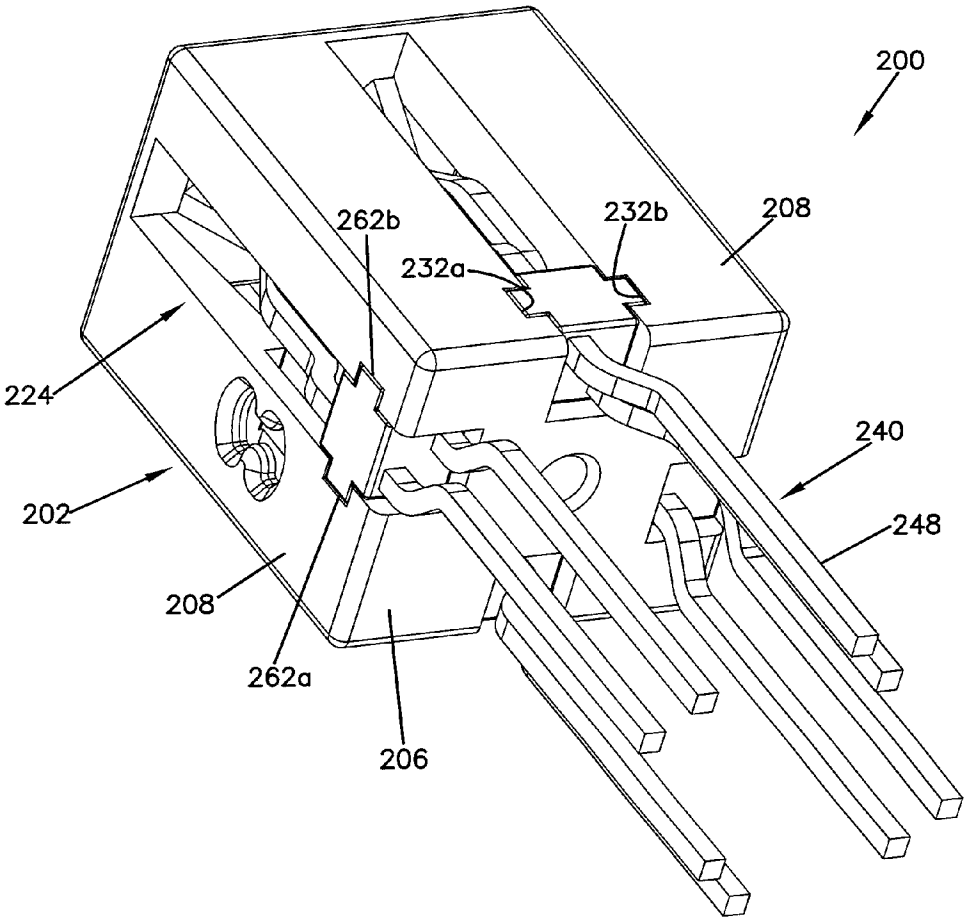
Figure 16:
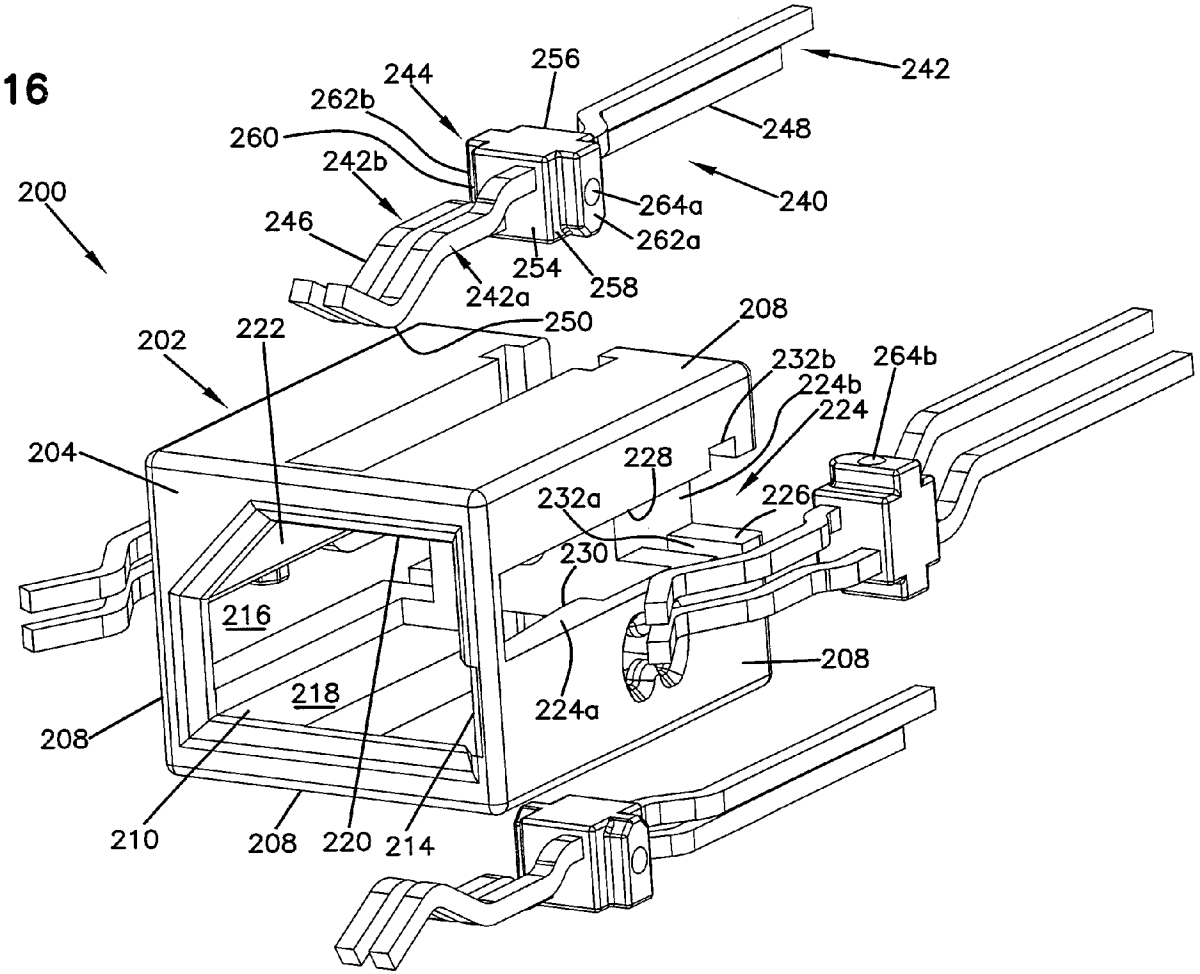
FIG. 16 is an exploded isometric view of the socket assembly of FIGS. 14 and 15.

Referring now to FIGS. 14-16, a socket assembly 200 is shown. The socket assembly 200 is adapted for communication with the plug 82.

The socket assembly 200 includes a socket body 202 having a first face 204 and an oppositely disposed second face 206. The socket body 202 further includes a plurality of exterior sides 208 that extend between the first and second faces 204, 206.

The socket body 202 defines a plug cavity 210 that is adapted to receive the second axial end portion 154 of the plug 82. The plug cavity 210 includes an opening 212 in the first face 204 of the socket body 202.

The plug cavity 210 includes a first sidewall 214, an oppositely disposed second sidewall 216, a third sidewall 218 and an oppositely disposed fourth sidewall 220. The third and fourth sidewalls 218, 220 extend between the first and second sidewalls 214, 216. In one aspect of the present disclosure, one of the first, second, third and fourth sidewalls 214, 216, 218, 220 includes an angle portion 222 that corresponds to the angle portion 184 on the second axial end portion 154 of the plug 82. The angle portion 222 of the plug cavity 210 and the angle portion 184 of the plug 82 allow for only a single orientation of the plug 82 relative to the socket assembly 200 for insertion of the plug 82 into the socket assembly 200.

In one aspect of the present disclosure, each of the exterior sides 208 includes a channel 224 having a first sidewall 226 and an oppositely disposed second sidewall 228. The channel 224 includes a first end portion 224*a* and a second end portion 224*b*. The first end portion 224*a* of the channel 224 defines an opening 230 to the plug cavity 210. The second end portion 224*b* of the channel defines a first notch 232*a* disposed in the first sidewall 226 and an oppositely disposed second notch 232*b* disposed in the second sidewall 228.

The socket assembly 200 further includes a plurality of contact assemblies 240. Each contact assembly 240 includes a plurality of contacts 242 and a retainer 244. In one aspect of the present disclosure, each contact assembly 240 includes a first contact 242*a* and a second contact 242*b*. Each of the plurality of contacts 242 includes a first end portion 246 and an oppositely disposed second end portion 248.

The first end portion 246 of each of the contacts 242 is adapted for engagement with the second axial end portion 154 of the plug 82 and one of the insulation displacement contacts 86. In one aspect of the present disclosure, the first end portion 246 includes a bend 250 that is adapted to engage the second end 132 of one of the insulation displacement contacts 86.

The retainer 244 is disposed between the first and second end portions 246, 248 of the contacts 242. The retainer 244 includes a body 252 having a front side 254, a back side 256, a first side 258 and a second side 260. The first and second sides 258, 260 extend between the front and back sides 254, 256. In one aspect of the present disclosure, the contacts 242 extend through the front and back sides 254, 256 of the body 252.

The body further includes a first tab 262*a* that extends outwardly from the first side 258 and a second tab 262*b* that extends outwardly from the second side 260. The first and second tabs 262*a*, 262*b* are adapted for receipt in the first and second notches 232*a*, 232*b*, respectively, of the channel 224 of the socket body 202. In one aspect of the present disclosure, the first tab 262*a* includes a first detent 264*a* that protrudes outwardly from the first tab 262*a* while the second tab 262*b* includes a second detent 264*b* that protrudes outwardly from the second tab 262*b*. The first and second detents 264*a*, 264*b* are adapted for retaining the first and second tabs 262*a*, 262*b* in the first and second notches 232*a*, 232*b*, respectively, of the channel 224 of the socket body 202.

With the first and second tabs 262*a*, 262*b* disposed in the first and second notches 232*a*, 232*b*, respectively, of the channel 224 of the socket body 202, the first end portions 246 of contacts 242 are disposed in the first end portion 224*a* of the channel 224 of the socket body 202. The first end portions 246 of the contacts 242 are disposed in the channel 224 such that the bends 250 of the contacts 242 pass through the opening 230 of the channel 224 and into the plug cavity 210. The second end portions 248 of the contacts 242 extend outwardly from the second face 206 of the socket body 202.

Figure 17:
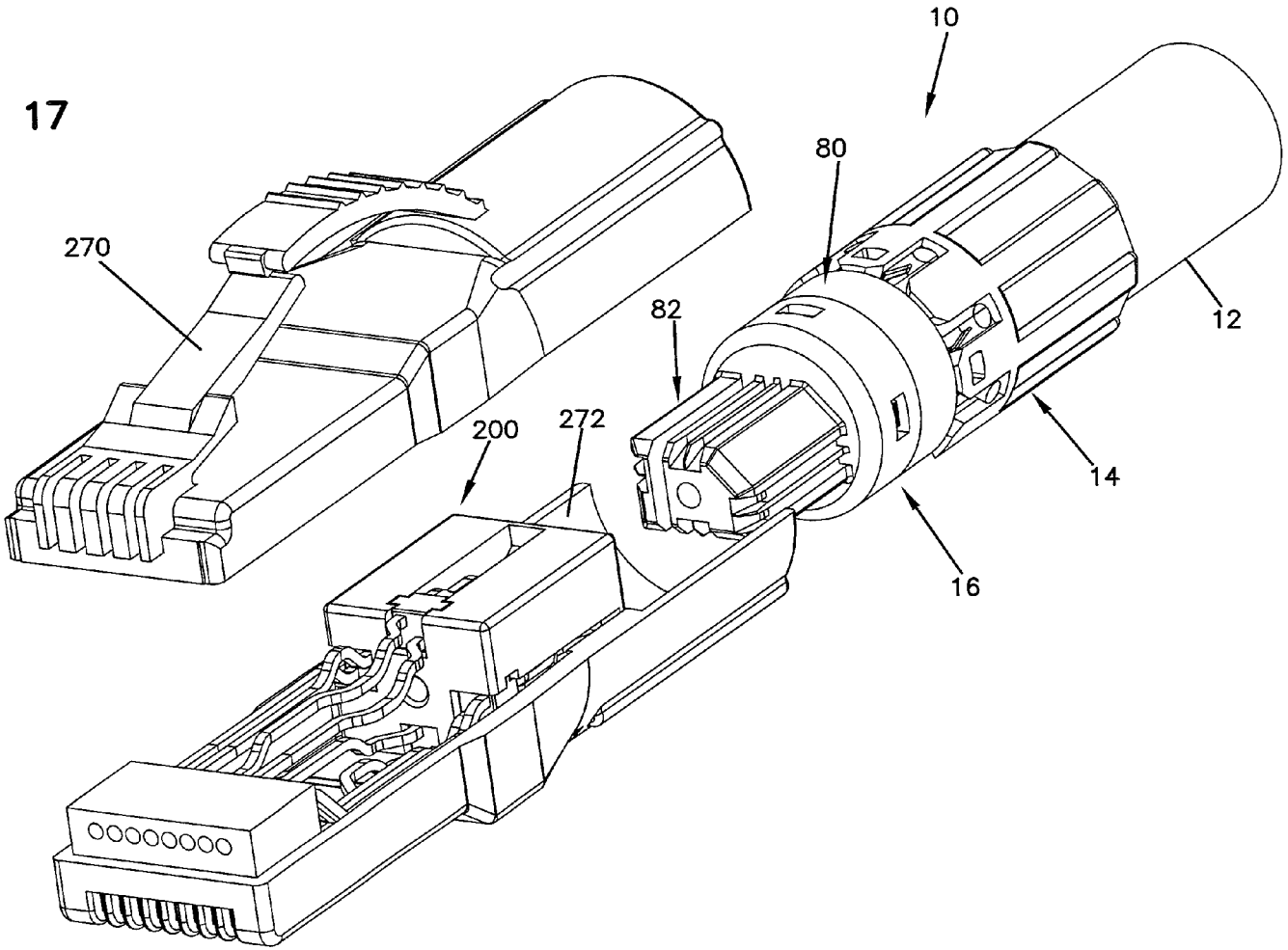
FIG. 17 is an exploded isometric view of a jack having the socket assembly of FIGS. 14 and 15.
Figure 18:
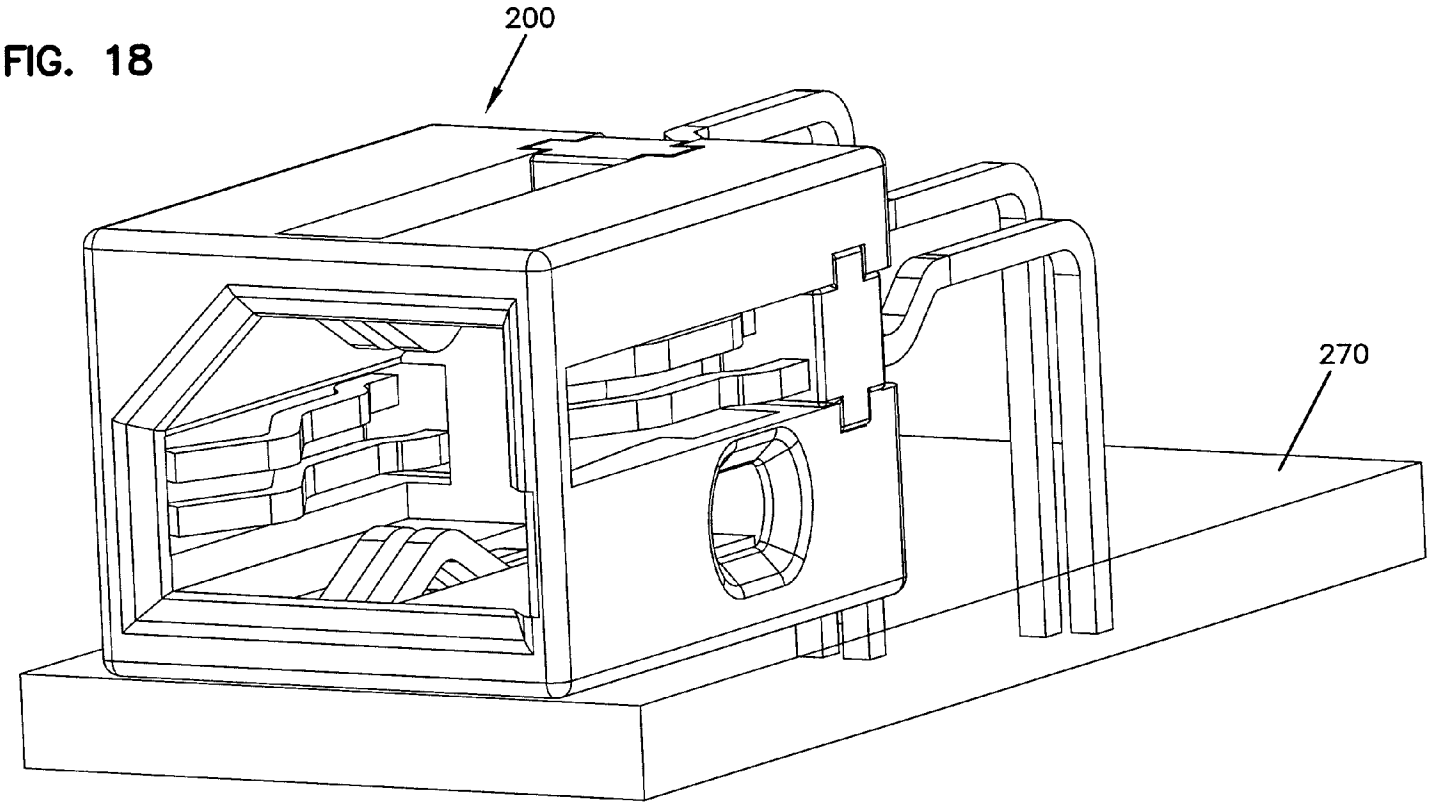
FIG. 18 is an isometric view of the socket assembly of FIGS. 14 and 15 mounted to a printed circuit board.

Referring now to FIGS. 17 and 18, the socket assembly 200 is adapted for electrical communication with a component 270. In the depicted embodiment of FIG. 17, the socket assembly 200 is adapted for electrical communication with a jack 270. In one aspect of the present disclosure, the jack 270 is an RJ-type jack (e.g., RJ11, RJ14, RJ45, Cat5E, etc.). The socket assembly 200 is disposed in an interior 272 of the RJ-type jack 270.

In the depicted embodiment of FIG. 18, the socket assembly 200 is adapted for electrical communication with a printed circuit board 270. In the depicted embodiment, the socket assembly 200 is mounted to the printed circuit board 270.

In an alternate embodiment, a plurality of socket assemblies 200 can be disposed on a panel that is adapted for rack mounting in telecommunications equipment.

Figure 19:
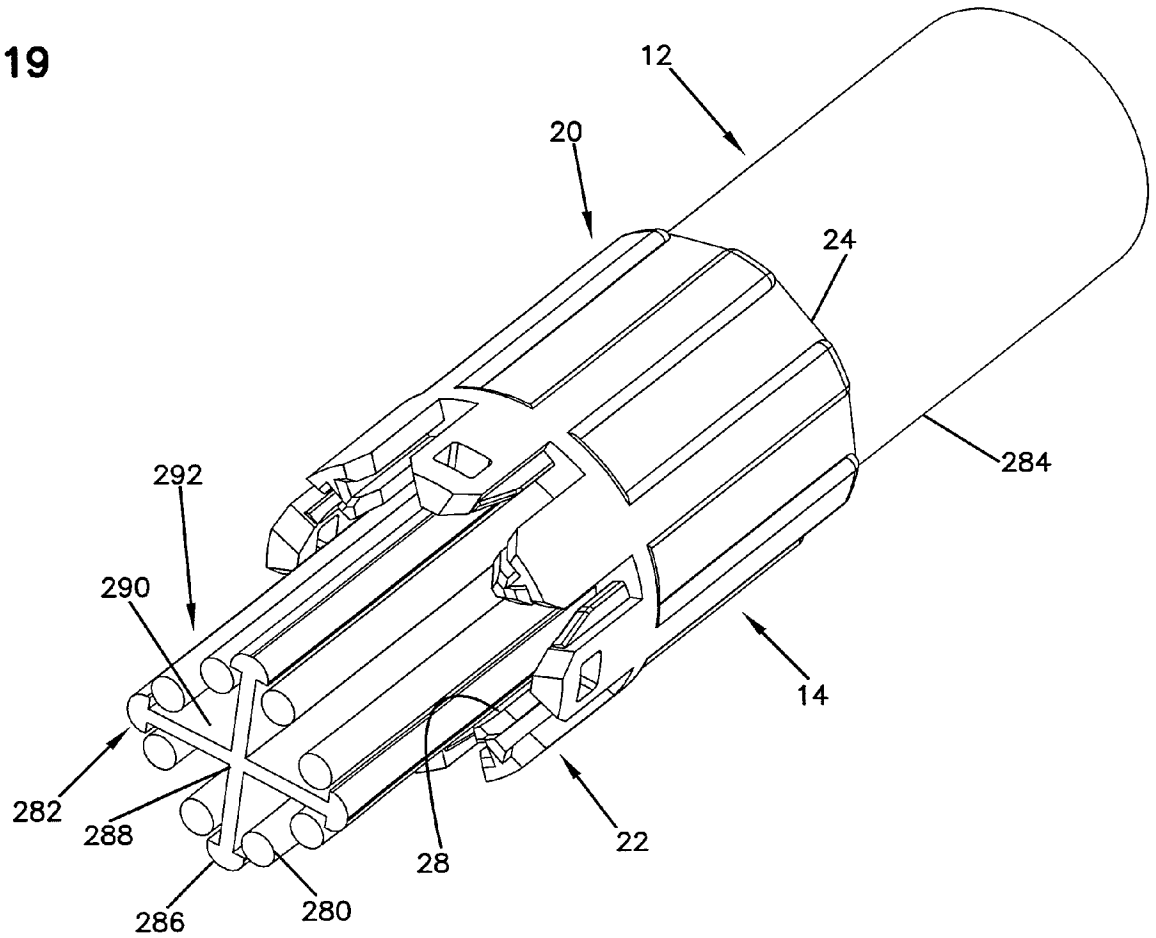
FIG. 19 is an isometric view of the sleeve of FIGS. 2 and 3 disposed over an end portion of a telecommunications cable.

Referring now to FIG. 19, the cable 12 will be described. The cable 12 includes a plurality of wires 280, a separator 282 and an outer jacket 284.

In one aspect of the present disclosure, the separator 282 extends the length of the cable 12. The separator 282 includes a plurality of projections 286 that radiate from a center 288 of the separator 282. In the depicted embodiment of FIG. 19, the separator 282 includes four projections 286. The plurality of projections 286 defines a plurality of compartments 290. Each compartment is disposed between adjacent projections 286.

The plurality of wires 280 extends the length of the cable 12. In the depicted embodiment of FIG. 19, the plurality of wires 280 includes eight wires 280. In one aspect of the present disclosure, the plurality of wires 280 is arranged in pairs. In the depicted embodiment of FIG. 19, the plurality of wires 280 includes four pairs of wires 280. In one aspect of the present disclosure, the wires 280 in each pair of wires 280 are twisted.

The pairs of wires 280 are disposed in the compartments 290 of the separator 282. The compartments 290 of the separator 282 keep the pairs of wires 280 separate from adjacent pairs of wires 280.

The outer jacket 284 surrounds the wires 280 and the separator 282. As the outer jacket 284 surrounds the wires 280, the outer jacket 284 provides environmental protection to the wires 280 over the length of the cable 12.

Figure 23:
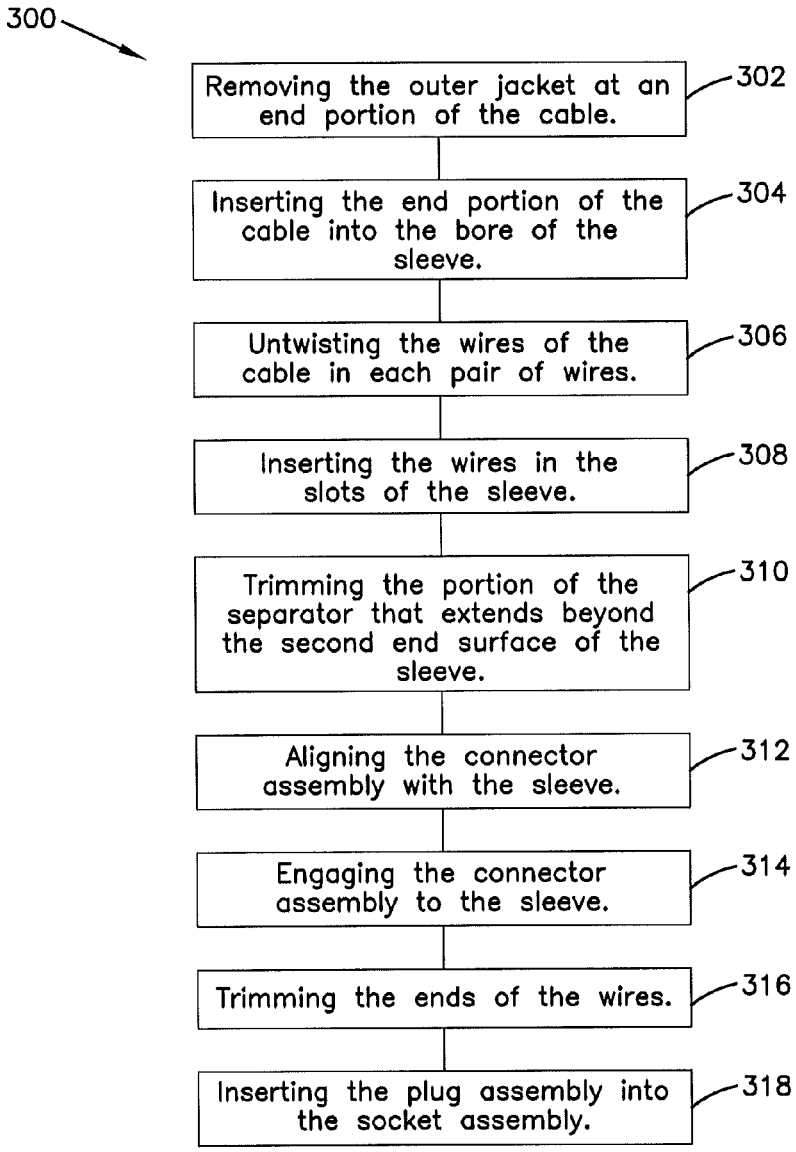
FIG. 23 is a representation of a method for installing the plug assembly of FIG. 1 onto the telecommunications cable.

A method 300 for installing the plug assembly 11 to the cable 12 will be described. Referring now to FIGS. 19 and 23, the outer jacket 284 of an end portion 292 of the cable 12 is removed or stripped in step 302 of the method 300. The removal of the outer jacket 284 of the end portion 292 of the cable 12 exposes the plurality of wires 280 and the separator 282. In one aspect of the present disclosure, about 30 mm of the outer jacket 284 at the end portion 292 of the cable 12 is removed.

In step 304, the end portion 292 of the cable 12 is inserted through the bore 28 of the sleeve 14. The end portion 292 of the cable 12 is passed through the first axial end portion 20 of the sleeve 14 until the end portion 292 extends outwardly from the second axial end portion 22 of the sleeve 14 such that the second axial end portion 22 of the sleeve 14 is adjacent the end portion 292 of the cable 12. In one aspect of the present disclosure, the end portion 292 of the cable 12 is inserted in the sleeve 14 until the first end surface 24 abuts the outer jacket 284 of the cable 12.

Figure 20:
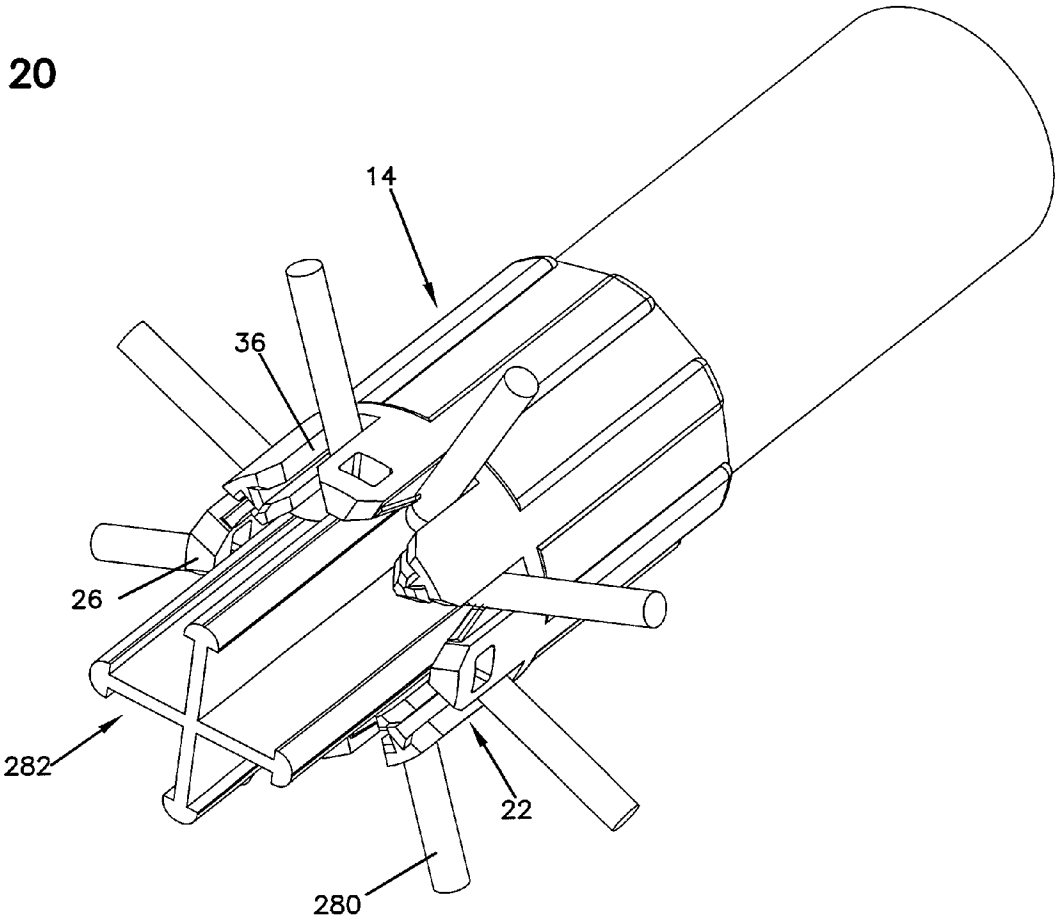
FIG. 20 is an isometric view of wires of the telecommunications cable disposed in slots of the sleeve.
Figure 21:
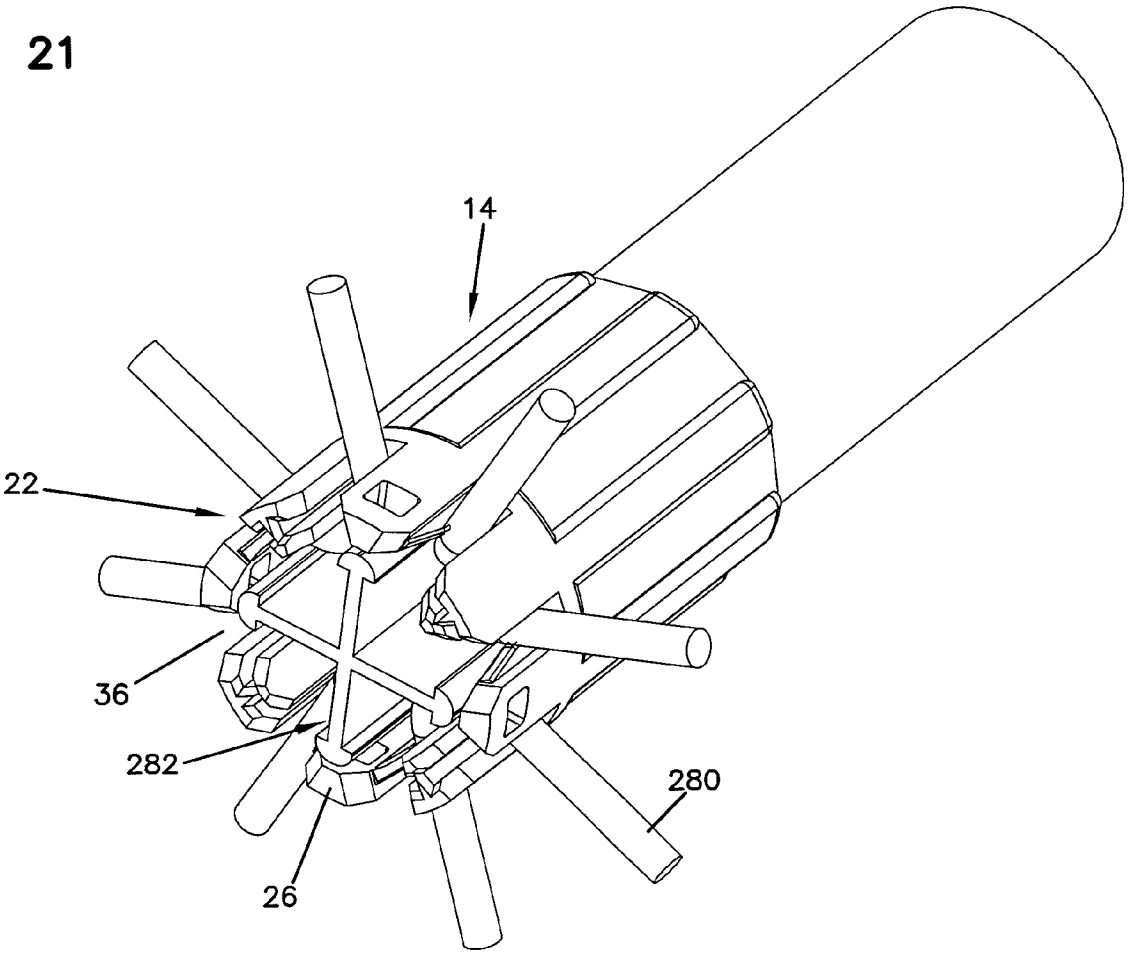
FIG. 21 is an isometric view of a separator of the telecommunications cable trimmed to a second end surface of the sleeve.
Figure 22:
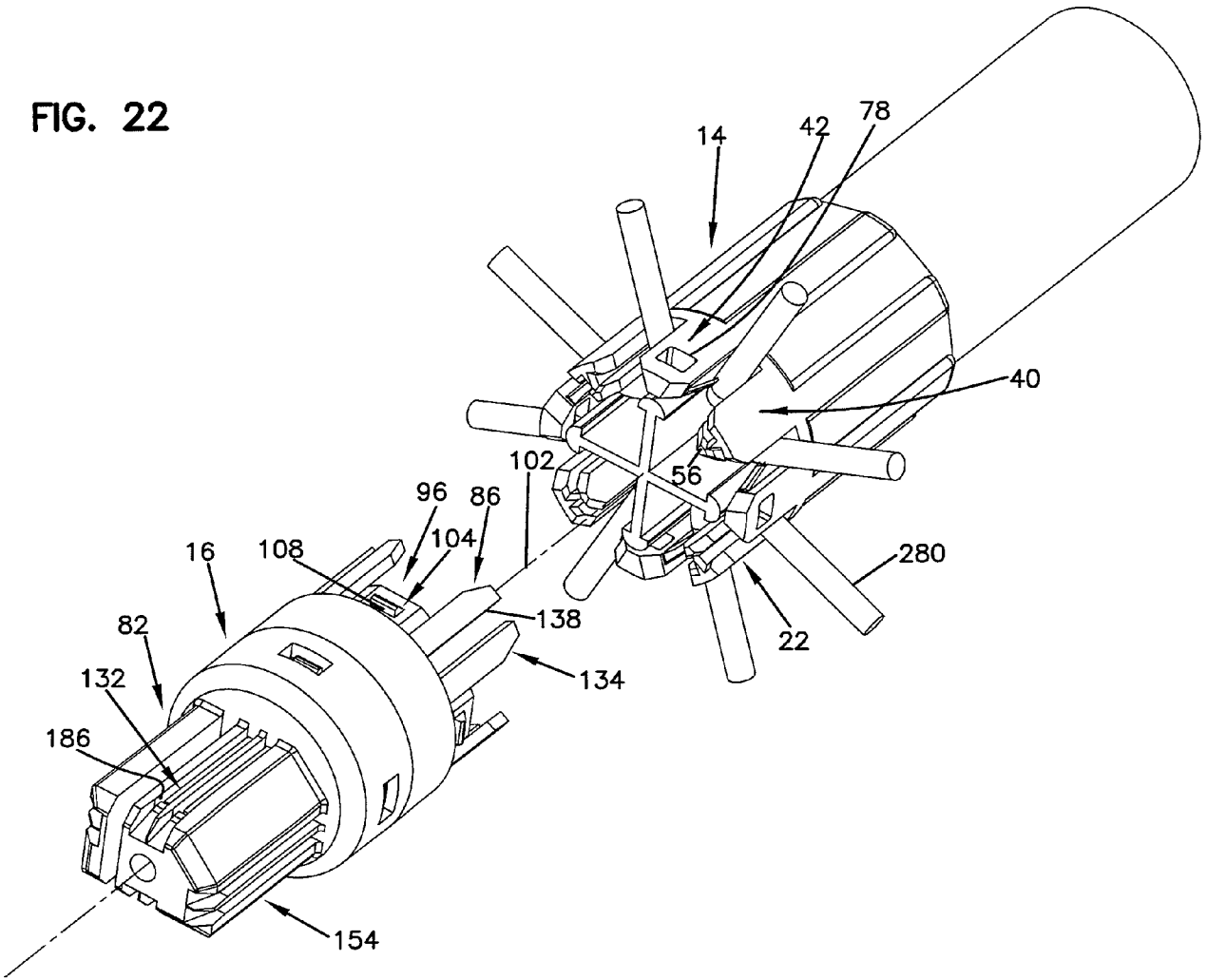
FIG. 22 is an isometric view of the connector assembly and the sleeve.

Referring now to FIGS. 20, 21 and 23, the wires 280 in each pair of wires 280 are untwisted in step 306. In step 308, each of the wires 280 is pulled back toward the second axial end portion 22 of the sleeve 14 such that each wire 280 enters the corresponding slot 36 in the second axial end portion 22 of the sleeve 14 through the opening 38 in the second end surface 26 of the sleeve 14. With the wires 280 in the slots 36 of the sleeve 14, the wires 280 extend radially outward from the sleeve 14. In step 310, a portion of the separator 282 that extends beyond the second end surface 26 is removed or trimmed.

Referring now to FIGS. 1, 14, 22 and 23, the connector assembly 16 is aligned with the sleeve 14 in step 312 such that the second sides 138 of the blade portions 134 of the insulation displacement contacts 86 are aligned with the channels 56 of the first plurality of tabs 40 of the second axial end portion 22 of the sleeve 14. In step 314, the connector assembly 16 is pushed into engagement with the sleeve 14. In one aspect of the present disclosure, as the connector assembly 16 is pushed into engagement with the sleeve 14, the first plurality of resilient latches 96 of the connector body 84 flex inwardly toward the central axis 102 until the first latch protrusions 104 are engaged with the catch 78 of the second plurality of tabs 42 of the sleeve 14. The connector assembly 16 is retained in the engaged position with the sleeve 14 by the abutment of the lips 108 of the first latch protrusions 104 of the connector body 84 and the catches 78 of the sleeve 14.

In step 316, an end 294 of each of the wires 280 is trimmed. In one aspect of the present disclosure, the end 294 is trimmed so that the wire 280 does not radially extend beyond the sleeve 14. In another aspect of the present disclosure, the trimming is done at the time the connector assembly 16 is engaged to the sleeve 14.

In one aspect of the present disclosure, steps 302 through 316 can be automated. Automation could be completed in a factory setting.

With the connector assembly 16 engaged to the sleeve 14, the blade portions 134 of the insulation displacement contacts 86 are in contact with the wires 280. The plurality of protrusions 70 of the sleeve 14 maintains the contact between the wires 280 and the contacts 86.

Electrical communication with the wires 280 can be achieved through contact with the second ends 132 of the insulation displacement contacts 86, which are accessible through the grooves 186 of the second axial end portion 154 of the plug 82. In step 318, the plug 82 is inserted into the socket assembly 200 so that the bends 250 of the contacts 242 are in electrical communication with the wires 280 through the second ends 132 of the insulation displacement contacts 86. In one aspect of the present disclosure, the insertion of the plug assembly 11 into the socket assembly 200 occurs at a location remote from the plug assembly installation location.

In one aspect of the present disclosure, the plug assembly 11 is potentially advantageous as it allows the telecommunications cable 12 to be preterminated with a plug that is adapted to fit into a receptacle or socket assembly 200 of a connector (e.g., RJ-45 connector, patch panel, etc.). This pretermination allows for the plug assembly 11 to be installed on a cable 12 at a location that is remote from the mating connector. In another aspect of the present disclosure, the plug assembly 11 is potentially advantageous as it allows the installation of the plug assembly to be automated. This may reduce the risk of radio frequency variations caused by manual termination of conventional connectors.

Various modifications and alterations of this disclosure will become apparent to those skilled in the art without departing from the scope and spirit of this disclosure, and it should be understood that the scope of this disclosure is not to be unduly limited to the illustrative embodiments set forth herein.

What is claimed is:

1. A plug assembly for terminating a telecommunications cable, the plug assembly comprising:

a sleeve having a first axial end portion and an oppositely disposed second axial end portion, the second axial end portion of the sleeve defining a plurality of channels, the second axial end portion including a first plurality of tabs that extend outwardly from the second axial end portion in an axial direction, the first plurality of tabs defining the plurality of channels, the second axial end portion including a second plurality of tabs that extend outwardly from the second axial end portion in the axial direction, and the second axial end portion defining a plurality of slots disposed between the first and second pluralities of tabs;

a connector assembly engaged to the second axial end portion of the sleeve, the connector assembly including:

a connector body having a first end portion and a second end portion;

a plurality of contacts disposed in the connector body, each of the plurality of contacts including a first end that extends outwardly from the first end portion of the connector body and a second end that extends outwardly from the second end portion of the connector body, the first ends of the plurality of contacts being disposed in the plurality of channels of the sleeve; and a plug engaged to the second end portion of the connector body, the plug including a plurality of grooves through which the second ends of the plurality of contacts are accessible.

2. The plug assembly of claim 1, wherein each of the second plurality of tabs defines a catch.

3. The plug assembly of claim 1, wherein the connector assembly is in snap-fit engagement with the second axial end portion of the sleeve.

4. A plug assembly for terminating a telecommunications cable, the plug assembly comprising:

a sleeve having a first axial end portion and an oppositely disposed second axial end portion, the second axial end portion of the sleeve defining a plurality of channels;

a connector assembly engaged to the second axial end portion of the sleeve, the connector assembly including:

a connector body having a first end portion and a second end portion;

a plurality of contacts disposed in the connector body, each of the plurality of contacts including a first end that extends outwardly from the first end portion of the connector body and a second end that extends outwardly from the second end portion of the connector body, the first ends of the plurality of contacts being disposed in the plurality of channels of the sleeve; and a plug engaged to the second end portion of the connector body, the plug including a plurality of grooves through which the second ends of the plurality of contacts are accessible; and a socket assembly including:

a socket body defining a plug cavity, the plug cavity being sized to receive the plug; and a plurality of contact assemblies having a first end and an oppositely disposed second end, the first end of the plurality of contact assemblies being disposed in the plug cavity of the socket body.

5. The plug assembly of claim 4, wherein the connector assembly is in snap-fit engagement with the second axial end portion of the sleeve.

6. The plug assembly of claim 4, wherein the second axial end portion includes a first plurality of tabs that extend outwardly from the second axial end portion in an axial direction, the first plurality of tabs defining the plurality of channels.

7. The plug assembly of claim 6, wherein the second axial end portion includes a second plurality of tabs that extend outwardly from the second axial end portion in the axial direction.

8. The plug assembly of claim 7, wherein the second axial end portion defines a plurality of slots disposed between the first and second pluralities of tabs.

9. The plug assembly of claim 7, wherein each of the second plurality of tabs defines a catch.

10. A cable assembly comprising:

a plug assembly including:

a sleeve having a first axial end portion and an oppositely disposed second axial end portion, the sleeve defining a bore that extends through the first and second axial end portions, the second axial end portion of the sleeve defining a plurality of slots, and the second axial end portion of the sleeve defining a plurality of channels;

a connector assembly engaged to the second axial end portion of the sleeve, the connector assembly including:

a connector body having a first end portion and a second end portion;

a plurality of contacts disposed in the connector body, each of the plurality of contacts including a first end that extends outwardly from the first end portion of the connector body and a second end that extends outwardly from the second end portion of the connector body; and a plug engaged to the second end portion of the connector body, the plug including a plurality of grooves through which the second ends of the plurality of contacts are accessible; and a cable having an end that is disposed in the bore of the sleeve, the cable including a plurality of wires, the plurality of wires extending into the plurality of slots in the sleeve and being in contact with the first ends of the plurality of contacts;

wherein the second axial end portion defines a plurality of protrusions that maintain contact between the first ends of the plurality of contacts and the plurality of wires.

11. The cable assembly of claim 10, wherein the first ends of the plurality of contacts is engaged in the plurality of channels.

12. The cable assembly of claim 10, wherein the plurality of wires includes a plurality of twisted pairs.

13. The cable assembly of claim 12, wherein the cable includes a separator defining a plurality of compartments, the plurality of twisted pairs of wires disposed in the plurality of compartments.

14. A method for installing a plug assembly to a cable, the method comprising:

inserting an end portion of a cable into a bore of a sleeve of the plug assembly;

inserting wires of the cable into slots of the sleeve so that the wires extend radially outward from the cable;

aligning a connector assembly with the sleeve; and engaging the connector assembly to the sleeve so that first ends of contacts in the connector assembly are in contact with the wires in the slots;

wherein the sleeve includes a plurality of protrusions that maintain contact between the wires and the contacts.

15. The method of claim 14, further comprising inserting a plug of the connector assembly into a socket assembly.

16. The method of claim 14, wherein the connector assembly and the sleeve are in snap-fit engagement.

17. The method of claim 14, wherein the connector assembly includes a plug defining a plurality of grooves through which second ends of the contacts are accessible.

18. A method for installing a plug assembly to a cable, the method comprising:

inserting an end portion of a cable into a bore of a sleeve of the plug assembly;

inserting wires of the cable into slots of the sleeve so that the wires extend radially outward from the cable;

aligning a connector assembly with the sleeve;

engaging the connector assembly to the sleeve so that first ends of contacts in the connector assembly are in contact with the wires in the slots; and inserting a plug of the connector assembly into a socket assembly;

wherein the socket assembly is disposed in a jack.

19. The method of claim 18, wherein the connector assembly and the sleeve are in snap-fit engagement.

20. The method of claim 18, wherein the plug defines a plurality of grooves through which second ends of the contacts are accessible.

21. A method for installing a plug assembly to a cable, the method comprising:

inserting an end portion of a cable into a bore of a sleeve of the plug assembly;

inserting wires of the cable into slots of the sleeve so that the wires extend radially outward from the cable;

aligning a connector assembly with the sleeve;

engaging the connector assembly to the sleeve so that first ends of contacts in the connector assembly are in contact with the wires in the slots; and inserting a plug of the connector assembly into a socket assembly;

wherein the socket assembly is disposed on a printed circuit board.

22. The method of claim 21, wherein the connector assembly and the sleeve are in snap-fit engagement.

23. The method of claim 21, wherein the plug defines a plurality of grooves through which second ends of the contacts are accessible.

* * * * *